US005451731A

United States Patent [19]

Yoshizumi et al.

[11] Patent Number: 5,451,731

[45] Date of Patent: Sep. 19, 1995

[54] CIRCUIT BREAKER AND DRIVING MECHANISM THEREOF

[75] Inventors: Toshiaki Yoshizumi; Mikio Hidaka, both of Amagasaki, Japan

[73] Assignee: Mitsubishi Denki Kabushiki Kaisha, Tokyo, Japan

[21] Appl. No.: 322,363

[22] Filed: Oct. 13, 1994

Related U.S. Application Data

[63] Continuation of Ser. No. 996,780, Dec. 23, 1992, abandoned.

[30] Foreign Application Priority Data

Dec. 27, 1991 [JP] Japan ..... 3-346510

[51] Int. Cl.[6] ..... H01H 33/16

[52] U.S. Cl. ..... 218/143; 218/2

[58] Field of Search ..... 200/17 R, 144 R, 145, 200/148 R, 148 A, 148 D, 148 F, 150 J, 150 F, 144 A, 144 B, 144 AP

[56] References Cited

U.S. PATENT DOCUMENTS

| | | | |
|---|---|---|---|
| 3,728,508 | 4/1973 | Netzel | 200/144 B |
| 4,009,458 | 2/1977 | Kishi et al. | 200/148 A |
| 4,044,210 | 8/1977 | Van Sickle | 200/148 H |
| 4,215,256 | 7/1980 | Sakaguchi et al. | 200/148 D |
| 4,243,855 | 1/1981 | Gratzmuller | 200/81.4 |
| 4,423,298 | 12/1983 | Tsukushi et al. | 200/144 AP |
| 4,424,428 | 1/1984 | Bernard et al. | 200/147 A |
| 4,454,394 | 6/1984 | Toyoda | 200/145 |
| 4,839,476 | 6/1989 | Okuno | 200/17 R |
| 5,091,614 | 2/1992 | Yamamoto et al. | 200/144 AP |
| 5,266,758 | 11/1993 | Pham et al. | 200/144 AP |

FOREIGN PATENT DOCUMENTS 63-52413 10/1988 Japan .

OTHER PUBLICATIONS

T. IEE Japan, vol. 111-B, No. 2, 1991, pp. 179-187, S. Hamano, et al., "Investigation of a New Extinguishing Principle for GCB" (with English Abstract).

*Primary Examiner*—A. D. Pellinen
*Assistant Examiner*—Michael A. Friedhofer
*Attorney, Agent, or Firm*—Oblon, Spivak, McClelland, Maier & Neustadt

[57] ABSTRACT

In a double-break type circuit breaker having resistor contacts which are to be connected in parallel with main contacts in not only closing operation but also breaking operation, the resistor contacts are opened by a force due to loading of elastic members in the breaking operation and the elastic members are loaded for storing the driving force In the closing operation.

10 Claims, 21 Drawing Sheets

CIRCUIT BREAKER AND DRIVING MECHANISM THEREOF

This application is a continuation of application Ser. No. 07/996,780, filed on Dec. 23, 1992, now abandoned.

BACKGROUND OF THE INVENTION

1. Field of the Invention

The present invention relates to a circuit breaker to be used in an electric power system.

2. Description of the Prior Art

A convention circuit breaker which is a doublebreak type gas-insulated circuit breaker with closing resistors is described referring to FIGS. 16 to 21.

FIG. 16 is a sectional side view showing a constitution of the conventional circuit breaker in a closed state. In FIG. 16, elements which are positioned in left-hand in the figure are further sectioned and elements in right-band are not sectioned. The elements in left band and the elements in right band are substantially the same and positioned substantially symmetrical.

In FIG. 16, an insulation gas such as $SF_6$ 102 is filled in a main tank 101. Two main contacts 200 are symmetrically positioned with respect to the center of the main tank 101 and they are supported by a frame conductor 301. The frame conductor 301 is supported by an insulation holder 302 in a center branch drum port of the main tank 101. The main contacts 200 and the frame conductor 301 are positioned on a center axis of the main tank 101. The main contacts 200 respectively consist of a stationary electrode 201 and a moving electrode 202.

FIG. 17 is a sectional side view showing a detail constitution of a switching part of the conventional circuit breaker. As shown in FIG. 17, the stationary electrode 201 and the moving electrode 202 are held by an insulation holder 203. Conductors 204 of the stationary electrodes 201 serve as cooling drums for cooling hot insulation gas in a breaking operation of the circuit breaker. In rear parts of the conductors 204, exhaust openings 204*a* are formed for exhausting the hot insulation gas therethrough. Connection parts 105 are respectively provided on the conductors 204 to be connected to connection conductors 104 which are respectively held by insulation spacers 103 at the both ends of the main tank 101.

As shown in FIGS. 16 and 17, the insulation tubes 203 respectively have a cylindrical shape. Capacitors 106 are provided on outer peripheries of the insulation tubes 203, and they are electrically connected in parallel with the main contacts 200 in a manner to share voltages of the main contacts 200 evenly. On outer peripheries of the conductors 204, two sets of plural resistors 500 are provided for restraining the surge when the circuit is closed. Resistor contacts 400 are respectively connected in series with respective sets of the resistors 500. The resistor contacts 400 are respectively provided on the outer peripheries of the insulation tubes 203 and obliquely below the main contacts 200. Furthermore, series connections of the resistor contact 400 and the resistors 500 are electrically connected in parallel with the main contacts 200. The moving electrodes 202 of the main contacts 200 and moving resistor contacts 409 of the resistor contacts 400 are respectively coupled with an insulation operation rod 303 via a link mechanism 300 which is provided in the frame conductor 301. The link mechanism 300 is connected to a hydraulic operation apparatus 700 in an operation housing 107 via another link mechanism 600 which is provided in the air.

Constitutions of the above-mentioned individual elements are described in detail. FIG. 17 shows a breaking state of the conventional circuit breaker. In FIG. 17, each of the stationary electrode 201 of the main contact 200 constitutes essentially of a main stationary contact 205, a stationary arc contact 206, a shield 207 and the conductor 204. The main moving electrode 202, which is positioned opposing to the stationary electrode 201, constitutes essentially of a main moving contact 208, a moving arc contact 209, a nozzle 210, a puffer cylinder 211, a piston 213 and a finger contact 214. A piston rod 212 of the piston 213 is slidably held on the frame contact in a manner to make the finger contact 214 serve as a guide. A stationary resistor contact 401 is positioned obliquely below the stationary electrode 201, slidably held on a resistor contact case 402. The resistor contact case is fixed on the shield 207 via an insulation base 403.

As shown in FIG. 17, each piston rod 212 is linked to a main lever 305 via a link 304. Each of the main lever 305 is rotatably held on the frame conductor 301. The insulation rod 303 is coupled to both (right and left sides in the figure) of the main levers 305 via other links 306. Each of the moving resistor contact 409 is linked to an end 308*a* of a lever 308 via a link 307. Each of the lever 308 is rotatably borne at substantially the center thereof by a pin 309. The pin 309 is provided at substantially the center between a rotation center of the main lever 305 and a coupling part of the link 304 and the main lever 305. The other end of the lever 308 is rotatably borne on a link 310. The link 310 is rotatably borne on the frame conductor 301. In such a link mechanism, the motion of the link part of the link 307 and the lever 308 due to the rotation of the main lever 305 can be considered as a linear motion, and thereby any transverse force does not occur in the moving resistor contact 409.

An upper end 303*a* of the insulation rod 303 is guided by a guide 311 which is provided on the frame conductor 301, and a lower end 303*b* of the insulation rod 303 is fixed on a shaft 601. The insulation rod 303 is positioned at the center of the insulation holder 302. The shaft 601 penetrates the center of the bottom face 302*a* of the insulation holder 302. A shaft real 602 is provided between the shaft 601 and the insulation holder 302 for guiding the sliding motion of the shaft 601 and for maintaining the seal of the $SF_6$ gas 102 in the main tank 101. An end 601*a* of the shaft 601 in the air is coupled to a hydraulic piston 701 of the hydraulic operation apparatus 700 via a link mechanism which is constituted by a link 603, a conversion lever 604 for perpendicularly converting the moving direction and a rod end 605.

The hydraulic operation apparatus 700 further comprises an accumulator for charging the oil and a oil pump unit (not shown in the figure) for increasing the pressure of the oil.

FIG. 18 shows a detail constitution of the resistor contact 400 in a breaking state of the circuit breaker. In FIG. 18, a restoration spring 404 is provided in an inner space of the resistor contact 401. An end 404*a* of the restoration spring 404 contacts an inside face 401*a* of the resistor contact 401 and the other end 404*b* of the restoration spring 404 contacts a piston 405 which is fixed on the resistor contact case 402. In the breaking state, the resistor contact 401 is pushed out by a pressing force of the restoration spring 404 since the resistor contact case 402 serves as a stopper. Orifices 406 are provided on the piston 405 for serving as a damper when the stationary resistor contact 401 slides. On the outer surface of the stationary resistor contact 401, a contact piece 407 is provided for electrically connecting the stationary resistor contact 401 to the resistor contact case 402. On an extension of the center axis of the stationary resistor contact 401, resistor elements 501 are provided via an adapter 408 in a manner to be connected electrically in series to the stationary resistor contact 401. The moving resistor contact 409 is positioned opposing to the stationary resistor contact 401, movably held by the frame conductor 301 and electrically connected to the frame conductor 301 by a contact piece 410.

FIG. 19 shows an installation of the resistors 500. For restoring the surge which occurs in the closing operation of the circuit breaker, the resistor contact 400, which is provided in parallel with the main contact 200, is closed prior to the closing of the main contact 200. And thereby, the resistors 500 which are provided in series with the resistor contact 400 are electrically connected. Generally, each of the resistor 500 consists of series connection of many resistor elements 501, thereby a necessary value of the resistor 500 or the series connection of the resistors 500 is/are given by the series connection of the resistor elements 501. And the heat load of the resistor 500 is partially shared by the resistor elements 501. Each of the resistor element 501 has a disk shape and is held by an insulation bar 502 which penetrates the center hole of the resistor element 501. An end 502*a* of the insulation bar 502 is fixed on an adapter 408 and the other end 502*b* is fixed on a conductor 503 which is used for connecting another resistor 500′. Another adapter 504 is provided to electrically contact with the left side of the series connection of the resistor elements 501 in the figure. A coil spring 505 is provided between the conductor 503 and the adapter 504 for supplying a pressure to the resistor elements 501. The conductor 503 is shielded by a shield 506 which is used for weakening the electric field. Similarly, the next resistors 500′ and 500″ are electrically connected in series to each other and held by an insulation base 507 on a shield 207. The other end 510 of the series connection of the resistors 500′ and 500″ is electrically connected to a conductor 204, thereby the main contact 200 is electrically in parallel to the series connection of the resistors 500, 500′ and 500″.

The motion of the conventional circuit breaker is described. The closing motion shown in FIG. 17 is executed as follows. By receiving a closing command (from a control apparatus not shown in the figure), the piston 701 of the hydraulic operation apparatus 700 and the rod end 605 start to move in left-hand in FIG. 17. Thereby, the lever 604 rotates in counterclockwise direction, and the shaft 601 moves upward via the link 603. The elements which are positioned in right- and left-hands in FIG. 17 move symmetrically, so that the explanation of the motion is mainly referring to the left-hand ones.

When the shaft 601 moves upward, the insulation operation rod 303 also moves upward. The main lever 305, which is coupled to the insulation operation rod 303 via the link 306, rotates in counterclockwise direction. As a result, the puffer cylinder 211 of the main contact 200 is moved in left-hand via the link 304 and the piston rod 212.

On the other hand, the lever 308, which is linked to the main lever 305 by the pin 309, rotates in clockwise direction around the coupling point 308*b* to the link 310 by the rotation in counterclockwise direction of the main lever 305. The moving resistor contact 409 moves in left-hand to approach the stationary resistor contact 401 via the link 307. At first, the moving resistor contact 409 contacts the stationary resistor contact 401, and thereby, the resistor contact 400 enters a closing state. At this time, the moving resistor contact 409 pushes the stationary resistor contact 401, and the restoration spring 404 is compressed by pushing of the stationary resistor contact 401 to the resistor contact case 402. Next, the moving arc contact 209 contacts the stationary arc contact 206. Furthermore, the main moving contact 208 contacts the main stationary contact 205. Thereby, the main contact 200 is closed.

The stationary resistor contact 401 is constituted to be able to move with the motion of the moving resistor contact 409. When the stationary resistor contact 401 is pressed by the moving resistor contact 409, the insulation gas of $SF_6$ in a space formed between the piston 405 and the stationary resistor contact 401 is compressed. When the compressed insulation gas 102 is exhausted from the orifice 406, the resistance serves as a damping force. When the piston 701 reaches to a closing position, the closing motion of the circuit breaker is completed. The closing state of the conventional circuit breaker is shown in FIG. 20.

Next, the breaking motion of the conventional circuit breaker is described. From the closed state of the conventional circuit breaker shown in FIG. 20, when a breaking command is issued from the control apparatus (not shown in the figure), the piston 701 of the hydraulic operation apparatus 700 and the rod end 605 start to move in right-hand in FIG. 17. The lever 604 rotates in clockwise direction and the shaft 601 moves downward via the link 603.

When the shaft 601 moves downward, the insulation operation rod 303 also moves downward. The main lever 305, which is linked to the insulation operation rod 303 via the link 306, rotates in clockwise direction. And the puffer cylinder 211 of the main contact 200 moves to the frame conductor 301 which is positioned in the center of the main tank 101 via the link 304 and the piston rod 212.

On the other hand, the lever 308, which is linked to the main lever 305 by the pin 309, rotates in counterclockwise direction around the coupling point 308b to the link 310 by following to the rotation of the main lever 305 in clockwise direction. The moving resistor contact 409 also moves to the frame contact 301 via the link 307. The stationary resistor contact 401 moves in right-hand by the pressure of the restoration spring 404 following to the movement of the moving resistor contact 409 in right-hand. However, the moving speed of the stationary resistor contact 401 is slower than that of the moving resistor contact 401, since the charged energy of the restoration spring 404 is small and the orifice formed on the piston 405 serves as a damper. Therefore, the resistor contact 400 becomes breaking state soon. After that, the main moving contact 208 of the main contact departs from the main stationary contact 205. The moving arc contact 209 also departs from the stationary arc contact 206, and an arc occurs between them. A state on the way of the breaking operation of the conventional circuit breaker is shown in FIG. 21.

The compressed insulation gas 102 by the piston 213 and the puffer cylinder 211 blows the arc, and thereby, the current flowing in the circuit breaker is cut. Most of the insulation gas heated by the arc passes through the conductor 204. The insulation gas 102 is cooled by the conductor 204 and exhausted from the opening 204*a*. When the piston 701 reaches to the breaking position, the breaking operation of the conventional circuit breaker is completed. The breaking state of the conventional circuit breaker is shown in FIG. 16.

When the voltage of the electric power system becomes higher and the conventional circuit breaker is used, for example, in 1000 kv system, it is necessary to restrain an overvoltage not only in the closing operation but also in the breaking operation of the circuit breaker for making a transmission-transformation system and/or transmission lines economical. In the conventional circuit breaker configured above, the resistor contact 400 is broken prior to the breaking of the main contact 200. Therefore, the overvoltage in the breaking operation can not be restrained. For restraining the overvoltage that occurs in the breaking operation, a resistor-breaking type circuit breaker, which inserts a resistor contact after breaking the main contact and breaking the resistor contact after a predetermined time period, is necessary. For such the time period of the insertion time of the resistor contact, a time of about 25 ms is necessary according to a computer simulation of the model system. The time period of 25 ms in the breaking operation is longer than that of 10 ms in the closing operation.

On the other hand, the circuit breaker is generally demanded to operate faster in the breaking operation than in the closing operation for obtaining a high circuit breaking performance. For satisfying such a condition, it is necessary that the resistor contact is opened in the vicinity of the final step of the breaking operation after the main contact is opened. Therefore, another special driving apparatus and a delay operation mechanism are demanded to constitute the high-voltage type circuit breaker.

In the above-mentioned demanded high-voltage type circuit breaker, the resistor is inserted not only in the closing operation but also in the breaking operation, so that the heat generated in the resistor becomes larger. For sharing the increased heat by respective resistor elements which constitute the resistor, the number of the resistor elements must be increased and the arrangement of the resistor elements becomes complex. Furthermore, if the resistor is supported by the frame conductor which is positioned at the center of the main tank, mechanical strength of the frame conductor and the other insulation holders and so on with respect to vibration become a problem.

Still more, for responding to the high voltage, the moving speed of the main contact and the resistor contact in the breaking operation must be increased in view of the dielectric strength after the current is cut. Therefore, a high power actuator is necessary to satisfy the moving speed of the main contact and the resistor contact, and each element constituting the circuit breaker must have a sufficient mechanical strength for fitting the high power actuator.

SUMMARY OF THE INVENTION

The purpose of the present invention is to solve the above-mentioned problems and to provide an improved circuit breaker fitting to the high voltage electric power system with down sizing and high reliability of the moving mechanism.

A circuit breaker in accordance with the present invention comprises:

a tank filled with an insulation gas;

two main contacts which are electrically connected in series and provided in the tank in a manner that main moving contacts of the main contact are driven in the axial direction of the tank for contacting and departing from stationary main contacts of the main contacts;

series connections of resistors and a resistor contact which are respectively provided to be electrically connected in parallel with the main contacts;

two insulation operation rods to be driven in a direction perpendicular to the axis of the tank and provided between the main contacts;

first link mechanisms, each coupling to respective ends of the insulation operation rods and the main contacts;

two driving mechanisms provided below the tank;

second link mechanisms, for coupling the other ends of the insulation operation rods to the driving mechanisms;

third link mechanisms for closing the resistor contacts prior to the closing of the main contacts and charging elastic members by driving forces of the driving mechanisms when the main contacts are driven for closing by the driving mechanisms via the insulation operation rods;

a fourth link mechanism for holding charged force of the elastic members;

coupling means for coupling the third link mechanisms and the fourth link mechanism; and release means for releasing the hold of the charged forces of the elastic members by the fourth link mechanisms, thereby breaking the resistor contacts after the breaking of the main contacts when the insulation operation rods are driven in a manner to break the main contacts.

In the above mentioned circuit breaker in accordance with the present invention, the main contacts are provided symmetrically with respect to the vertical axis at the center of the tank in a first horizontal plane;

the insulation operation rods are provided perpendicular to the moving direction of the main contacts; and two hydraulic operation apparatuses are provided symmetrically with respect to the vertical axis of the tank in a second horizontal plane.

Furthermore, in the circuit breaker in accordance with the present invention, a damper, which moves linearly, is coupled to the coupling means for reducing a shock at a final stage of motion of the resistor contact in breaking operation.

Still more, in the circuit breaker in accordance with the present invention, the resistor contacts are provided substantially just below the tank in a manner that the moving directions of the resistor contacts are substantially the same as the direction of the center line of the tank.

Still more, in the circuit breaker in accordance with the present invention, moving directions of the two main contacts are opposite to each other in the breaking operation and the closing operation;

the insulation operation rods and the main contacts are arranged perpendicular to the moving directions of the main contacts;

each of the first link mechanism comprises a first link which is coupled to an end of the insulation operation rod, a second link which is coupled at an end thereof to a main moving contact of the main contact, and a first lever which is coupled between the other end of the first link and the other end of the second link and rotatably borne on the tank; and the third link mechanism comprises a second lever which is rotatably coupled to an arm of the first lever in the vicinity of the main moving contact, a third link which is coupled with a moving resistor contact of the resistor contact, a fourth link which is disposed to overlap the first lever, coupled with the third link at an end thereof when the main contacts and the resistor contacts are in the breaking position and coupled with an end of the second lever at the other end thereof, and a fifth link which is rotatably borne on the fixed base and coupled with the other end of the second lever.

Still more, in the circuit breaker in accordance with the present invention, the main contacts and the resistor contacts are held perpendicular to the axis of the tank by an insulation holder which is fixed on the tank;

an end of each resistor is fixed on the fixed base via an insulation spacer;

an end of each conductor which penetrates the resistor is insulatively held from the resistor by the insulation spacer;

a main stationary contact of the main contact and the conductor and a resistor stationary contact of the resistor contact and the resistor are connected by a movable conductive connection parts.

Still more, in the circuit breaker in accordance with the present invention, the main contacts and the resistors are disposed in axial direction of the tank;

the main contact serves as a puffer cylinder for spouting an insulation gas to the main stationary contact thereof;

a conductor, which is electrically connected to the main stationary contact, is disposed between the main contact and the resistors;

branch parts are formed on a part of the conductor in the vicinity of the resistors for preventing the spouting of the insulation gas to the resistors in the breaking operation of the main contact.

Still more, in the circuit breaker in accordance with the present invention, sixth links are respectively coupled to the two third link mechanisms at an end of them;

the other ends of the sixth links are respectively coupled to damping rods for constituting the link means;

the charged force of the elastic member is held by an engagement of a latch with the damping rods when the resistor contacts are closed; and a fourth link mechanism is provided for releasing the charged force of the elastic member in a manner that the main contact is opened by a rotation of the first lever in a predetermined angle and triggering the engagement of the latch and the damping rods by further rotation of the first lever in another predetermined angle after the breaking of the main contacts.

In another circuit breaker in accordance with the present invention, series connection of two main contacts is provided in a tank filled with an insulation gas in a manner that moving contacts of the main contacts are movable in axial direction of the tank thereby to open and close the main contacts;

series connections of a resistor and a resistor contact are respectively connected in parallel in the main contact in the tank;

the resistor contacts are closed before the closing of the main contacts and opened after the breaking of the main contacts;

the resistor contact comprises a first contact having a circular contacting part and a second contact contacting and departing from the first contact; and magnetic field generating means is provided on an outer periphery of an end of the contacting part of the first contact.

In still other circuit breaker in accordance with the present invention, series connection of two main contacts is provided in a tank filled with an insulation gas in a manner that moving contacts of the main contacts are movable in axial direction of the tank thereby to open and close the main contacts;

two insulation operation rods are provided between and below the main contacts in a direction perpendicular to the axis of the tank;

one ends of the insulation operation rods are respectively coupled to the main contacts via first link mechanisms;

two hydraulic operation apparatuses are provided below the tank in a manner that directions of the driving force generated by the hydraulic operation apparatuses are opposing to each other and respectively connected to the other ends of the insulation operation rods via second link mechanisms; and a synchronizing controller is provided between the hydraulic operation apparatuses for generating an oil pressure generating signal by receiving a breaking or closing command and has pipings having the same sections and the lengths for transmitting the oil pressure signal to the hydraulic operation apparatuses.

A driving mechanism of a circuit breaker for charging a driving force and releasing the charged force for breaking and closing a switching part in accordance with the present invention comprises:

a pair of first torsion bars coupled by a coupling member which is rotatably held on a first fixed frame part in a manner that center lines of the first torsion bars are on the same line;

a pair of adapters respectively fixed on the ends of the first torsion bars and rotatably held on second fixed frame parts;

a pair of second torsion bars provided in parallel with the first torsion bars with a predetermined distance in a manner that one ends of the second torsion bars are respectively fixed on the adapters and the other ends of the second torsion bares are respectively fixed on the first fixed frame part.

In the circuit breaker in accordance with the present invention which is configured above, two main contacts which are electrically connected in series are respectively driven by the different driving mechanisms via the different insulation operation rods. Thereby the driving mechanisms and the insulation operation rods are made to be light weight and small. Furthermore, the elastic members for supplying a driving force for breaking the resistor contact is charged in the closing operation wherein the load of the hydraulic operation apparatus is relatively small.

Since the main contacts which are electrically connected in series, the insulation operation rods and the hydraulic operation apparatuses are symmetrically provided with respect to the axis of the tank, the length of the tank and the operation housing can be formed smaller than those of the conventional circuit breaker.

The elastic members for breaking the resistor contacts are coupled to each other, so that the motions of the resistor contacts are synchronized.

The main moving contacts of the main contacts and the insulation operation rods are coupled by the first link mechanisms. Furthermore, the first link mechanisms and the moving resistor contacts of the resistor contacts are coupled by the third link mechanisms. The driving forces are transmitted to the contacts without mechanical shock, since the mechanical shocks are absorbed by the first and third link mechanisms.

The main contacts and the resistor contacts are held by the insulation holder which is provided perpendicular to the axis of the tank. Ends of the resistors and the end of the conductor which insulatively penetrates the resistor in the same side are held by the same insulation spacer on the tank. Furthermore, the main stationary contacts of the main contacts and the conductors are connected by the disconnectable couplers. Similarly, the stationary resistor contacts of the resistor contacts and one of the resistors are connected by the disconnectable couplers. As a result, assembling of the elements in the tank can be easier than that in the conventional circuit breaker.

The puffer-type main contacts and the resistors are provided in parallel with the axis of the tank and the branch parts are formed between the main contacts and the resistors. Therefore, the resistors are protected from the blowing of the insulation gas exhausted from the main contacts.

The two third link mechanisms which are respectively coupled to the elastic members are coupled to the damping rods by the link means. When the resistor contacts are closed, the charged force of the elastic members are held by engagements of the latches with the damping rods. After the main contacts are opened by the rotation of the first levers in a predetermined angle, the engagements of the latches and the damping rods are released by the fourth link mechanism for releasing the charged forces of the elastic members. Therefore, the timing of the releasing of the charged forces of the elastic members can easily be adjusted.

Each resistor contact is constituted by a first contact having a circular contacting part and a second contact which is contacted to and departed from the first contact. Magnetic field generating means is provided on the outer periphery of the end of the first contact. Therefore, the arc generated between the first and second contacts is expanded in radial direction by the magnetic field.

The two hydraulic operation apparatuses which respectively drive the main contacts are provided in a manner that the directions of the driving forces generated by them are opposing to each other. The synchronizing controller is provided between both of the hydraulic operation apparatuses. Since, the synchronizing controller and the hydraulic operation apparatuses are connected by the pipings which have the same section and length, the oil pressure signal is supplied to both of the hydraulic operation apparatuses at the same time.

In the driving mechanism of the circuit breaker in accordance with the present invention, the elastic members for closing the resistor contacts are constituted by a pair of the first torsion bars and a pair of the second torsion bars. The first torsion bars are coupled by the coupling member. The first and second torsion bars are respectively coupled by the adapters in parallel with each other. Therefore, the driving force is charged in the first and second torsion bars by rotating the coupling member.

While the novel features of the invention are set forth particularly in the appended claims, the invention, both as to organization and content, will be better understood and appreciated, along with other objects and features thereof, from the following detailed description taken in conjunction with the drawings.

It will be recognized that some or all of the Figures are schematic representations for purposes of illustration and do not necessarily depict the actual relative sizes or locations of the elements shown.

DESCRIPTION OF THE PREFERRED EMBODIMENTS

Figure 1:
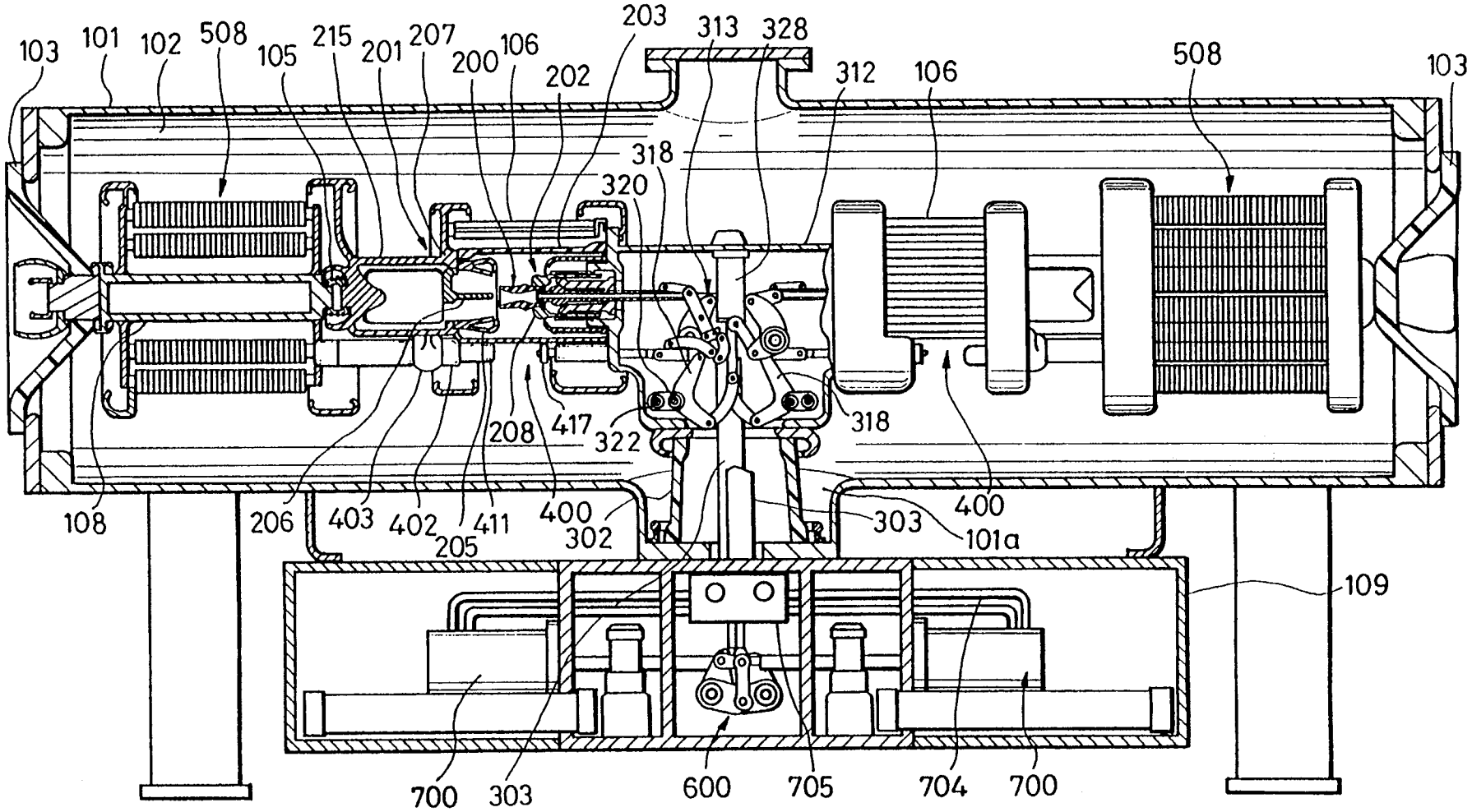
FIG. 1 is a sectional side view showing a constitution of a circuit breaker in accordance with the present invention.
Figure 2:
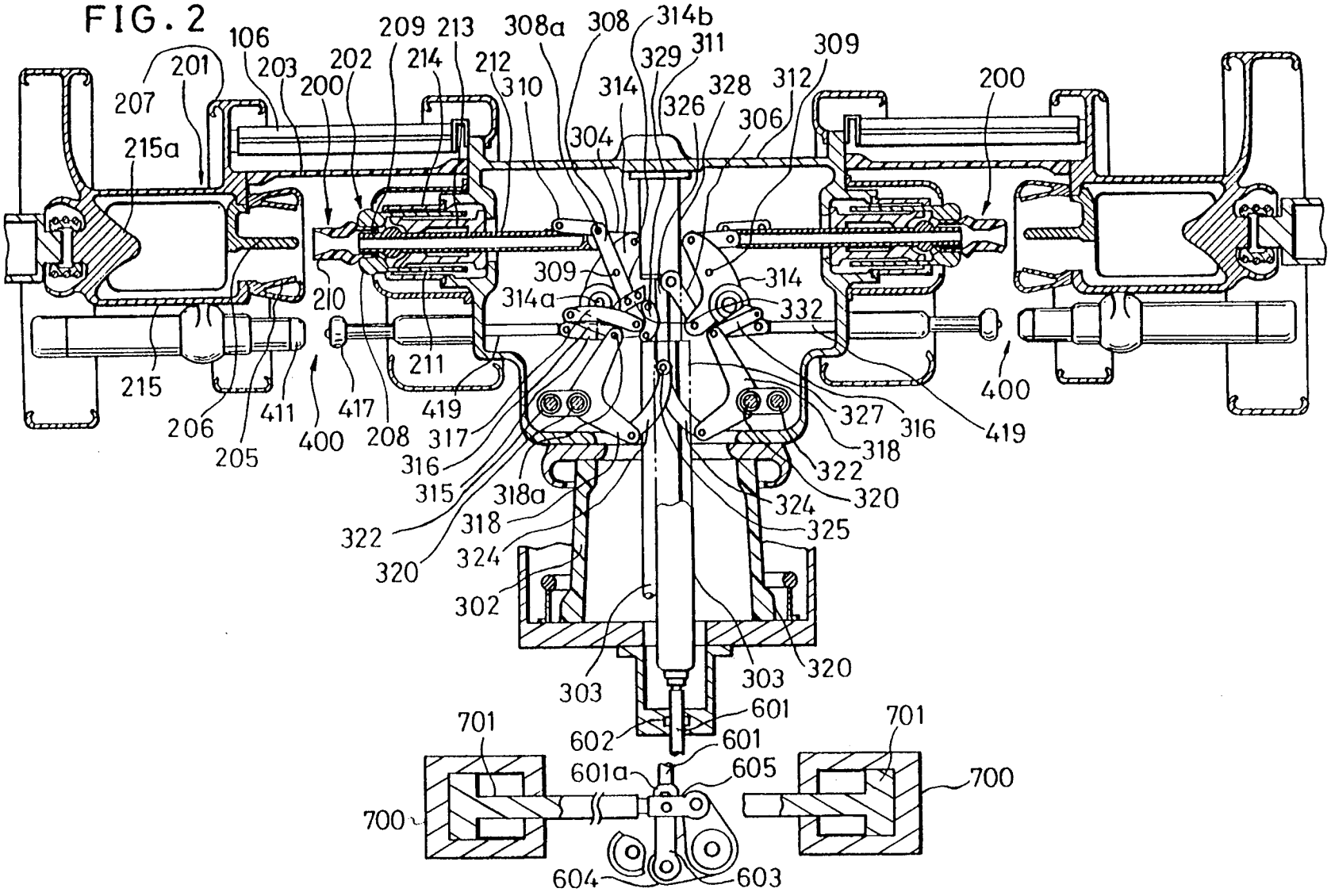
FIG. 2 is a sectional side view showing a detail constitution of a switching part of the circuit breaker shown in FIG. 1.

A preferred embodiment of a circuit breaker in accordance with the present invention is described referring to FIGS. 1 to 15. FIG. 1 is a partially sectional side view of a whole constitution of the circuit breaker. In FIG. 1, elements which are positioned in left-hand in the figure are further sectioned and elements in right-hand are not sectioned. The elements in left hand and the elements in right hand are substantially the same and positioned substantially symmetrical. FIG. 2 is a sectional side view showing a detailed constitution of the switching part of the circuit breaker in this embodiment.

In FIG. 1, an insulation gas such as $SF_6$ 102 is filled in an inner space of a main tank 101. Two main contacts 200 are held by a frame conductor 312 in the main tank 101. The frame conductor 312 is held by an insulation holder 302 in a branch part 101*a* of the main tank 101. The (right and left) main contacts 200 are positioned in a manner that their moving axis are symmetrical with respect to a center axis of the tank 101 and them moving directions are opposite to each other on a horizontal plane.

The following descriptions are mainly referring to the elements positioned in left-hand in FIG. 1, and the elements positioned in right-hand are substantially the same as those in left-hand. Therefore, most of the descriptions of the elements in right-hand are omitted. The main contact 200 consists of a moving electrode 202 and a stationary electrode 201, and these are connected by an insulation tube 203. A conductor 215 of the stationary electrode 201 serves as a cooling tube for cooling insulation gas which has been heated in a breaking operation of the circuit breaker. Insulation spacers 103 are provided on both ends of the main tank 101 and connection conductors 108 are respectively held on the insulation spacers 103. Conductive connector 105 is provided between an end of the conductor 215 and the connection conductor 108 for electrically connecting them.

The insulation tube 203 has a cylindrical shape. A number of capacitors 106 are provided around an outer periphery of the insulation holder 203, and terminals thereof are electrically connected across the main stationary contact 201 and the main moving contact 202 of the main contact 200 in a manner to share the voltages evenly. On outer peripheries of the connection conductor 108, plural resistors 508 are respectively provided for restraining the surge when the circuit breaker is closed or opened. Resistor contact 400 is provided electrically in series with the resistors 508. The resistor contact 400 is positioned on the outer periphery of the insulation tube 203 and below the center axis of the main tank 101. The resistor contact 400 is electrically connected in parallel with the main contact 200. The resistor contacts 400 which are positioned in left-hand and right-hand are provided on the same line.

Figure 5:
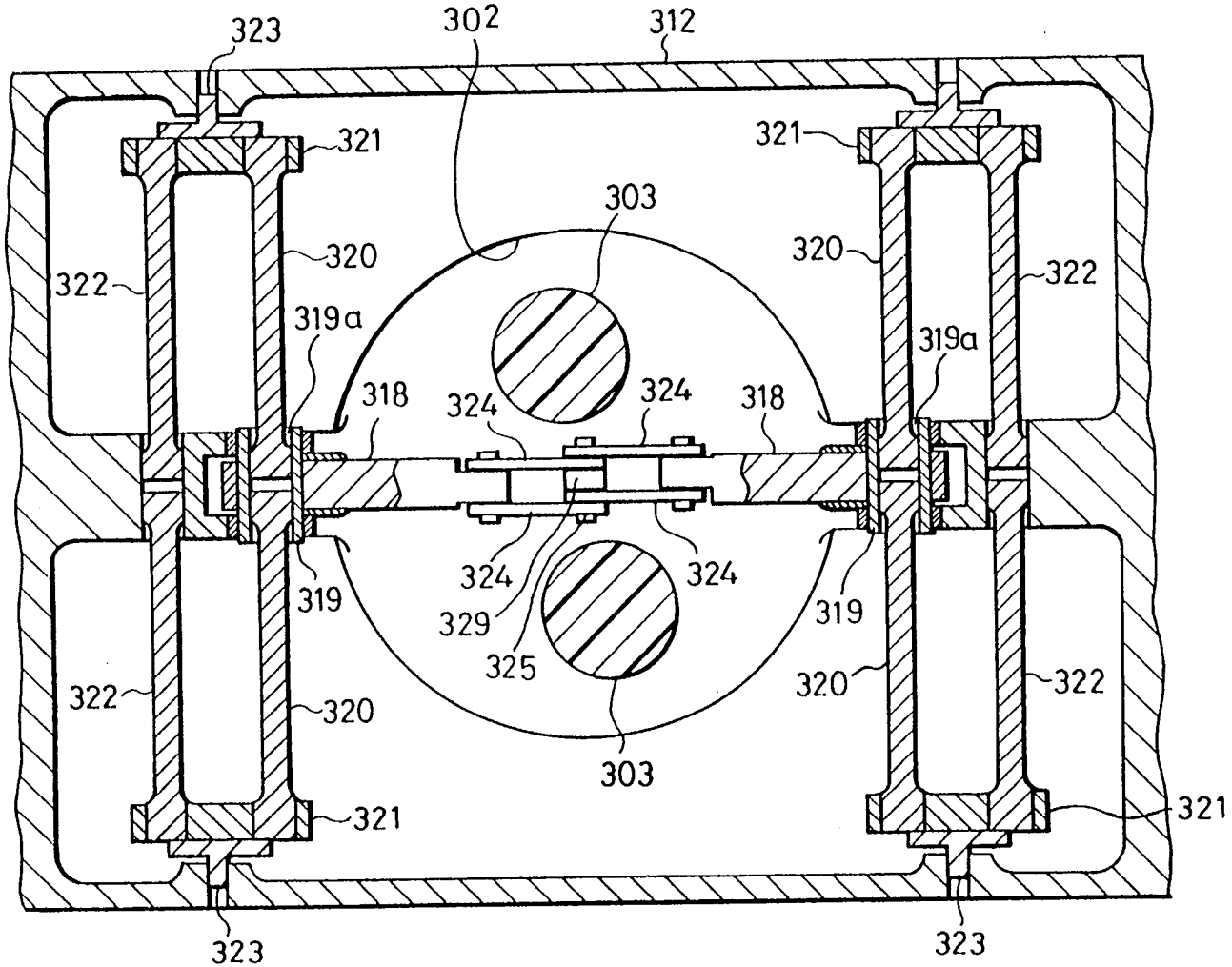
FIG. 5 is a sectional plan view showing a detail constitution in a frame conductor 312 of the circuit breaker shown in FIG. 1.
Figure 7:
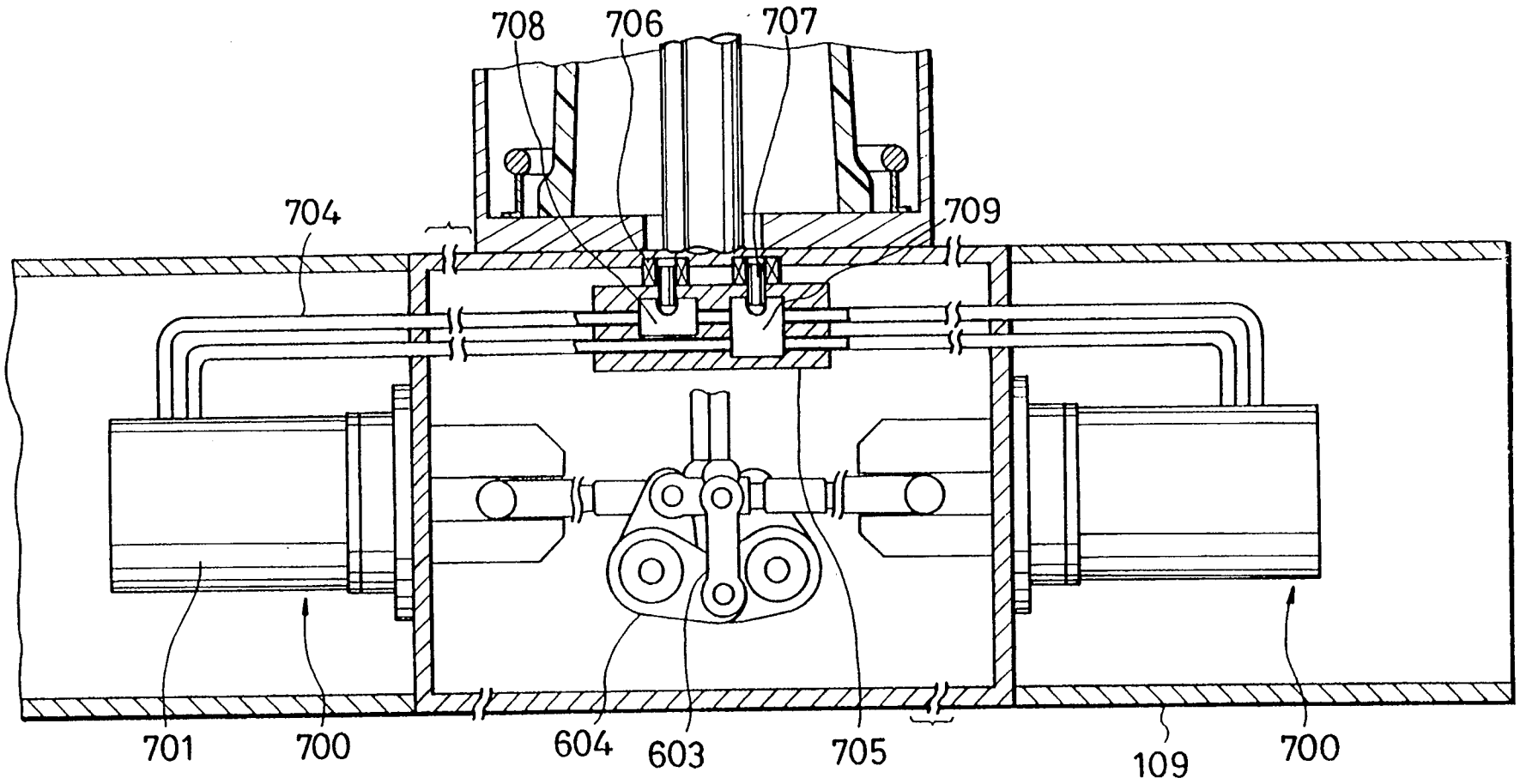
FIG. 7 is a sectional side view showing a detail constitution of a hydraulic operation apparatus of the circuit breaker shown in FIG. 1.

The moving electrode 202 of the main contact 200 and moving resistor contact 417 are coupled with an insulation operation rod 303 via a link mechanism 313 which is provided in the frame conductor 312. FIG. 5 is a sectional plan view showing a part of the driving mechanism of the circuit breaker in this embodiment. As shown in FIG. 5, two insulation operation rods 303 are positioned symmetrical with respect to the vertical center axis of the insulation holder 302 and provided on the same vertical planes. Furthermore, as shown in FIG. 1, the insulation operation rods 303 are connected to hydraulic operation apparatuses 700 via link mechanisms 600 which are in the air. The hydraulic operation apparatuses 700 are provided in an operation housing 109. A synchronizing controller 705, which is connected to the two hydraulic operation apparatuses by pipings 704, is provided in a center part of the operation housing 109. The hydraulic operation apparatuses 700 are respectively positioned symmetrical with respect to the synchronizing controller 705. FIG. 7 is a sectional side view showing the detailed constitution in the operation housing 109. The hydraulic operation apparatuses 700 that are shown in FIG. 7 comprise a hydraulic piston 701, an accumlator (not shown) and oil pump unit (not shown).

As shown in FIG. 2, the stationary electrode 201 of the main contact 200 is constituted by a main stationary contact 205, a main arc contact 206, 207 and a conductor 215. The moving electrode 202 is constituted by a main moving arching contact 208, a moving contact 209, a nozzle 210, a puffer cylinder 211, a piston 213 and a finger contact 214.

Figure 3:
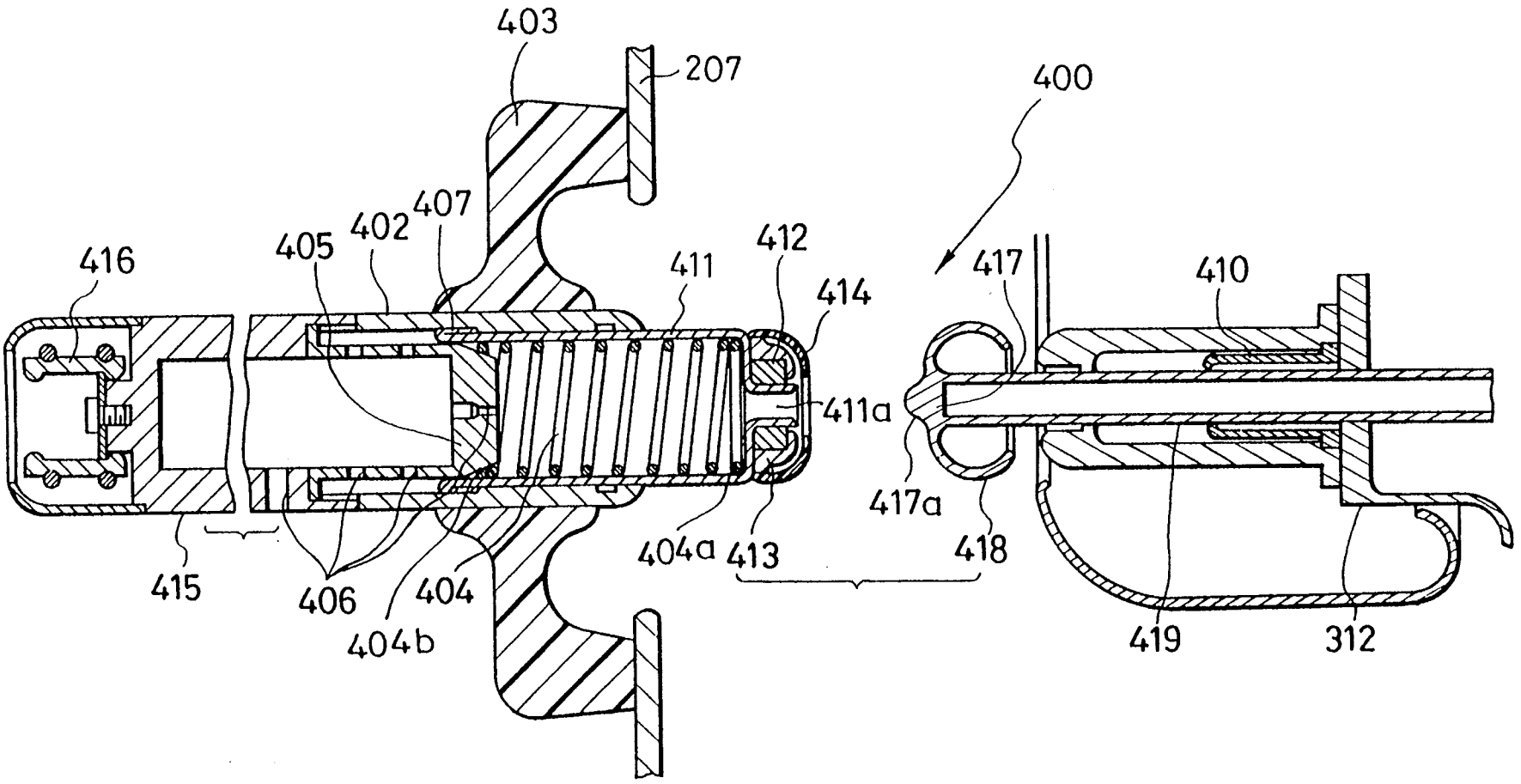
FIG. 3 is a sectional side view showing a detail constitution of a resistor contact 400 of the circuit breaker shown in FIG. 1.

FIG. 3 is a sectional side view showing a detail constitution of the resistor contact 400. As shown in FIG. 3, the stationary resistor contact 411, which is positioned below the center axis of the main tank 101, is slidably held on a resistor contact case 402. As shown in FIG. 1, the resistor contact case 402 is fixed on a shield 207 via an insulation adapter 403. The stationary resistor contact 411 has a cylindrical shape. A ring-shaped permanent magnet 412 is provided on an outer periphery of an end part of the stationary resistor contact 411, for moving an arc that occurs in the breaking operation. The permanent magnet 412 is held by a shield 413 which serves for reducing the magnetic field in the vicinity of the outer periphery of the resistor contact 411. Furthermore, outside of the shield 413 is enclosed by an insulation shield 414. An end 411*a* of the stationary resistor contact 411 is opened and a restoration spring 404 is provided in an inner space of the stationary resistor contact 411. An end 404*a* of the restoration spring 404 contacts the stationary resistor contact 411 and the other end 404*b* contacts a piston 405 which is provided in the resistor contact case 402. In the breaking state of the resistor contact 400, the stationary resistor contact 411 is pushed out from the resistor contact case 402 by the pressure of the restoration spring 404. On the piston 405, plural orifices 406 are formed. The orifices 406 serve as a damper for reducing the shock of the stationary resistor contact 411 in closing operation of the resistor contact 400. A contact member 407 is provided between an outer face of the stationary resistor contact 411 and an inner face of the resistor contact case 402. A conductor connection part 416 is formed on an end of the conductor 415 which is fixed on the resistor contact case 402. The moving resistor contact 417 has a protrusion 417*a* on an end thereof for contacting the stationary resistor contact 411 when the resistor contact 400 is closed. Furthermore, in the vicinity of the protrusion 417*a* of the moving resistor contact 417, a shield 418 for reducing the electric field is formed. A rod part 419 of the moving resistor contact is slidably held by and electrically connected to the frame conductor 312 via a contact member 410.

Figure 4:
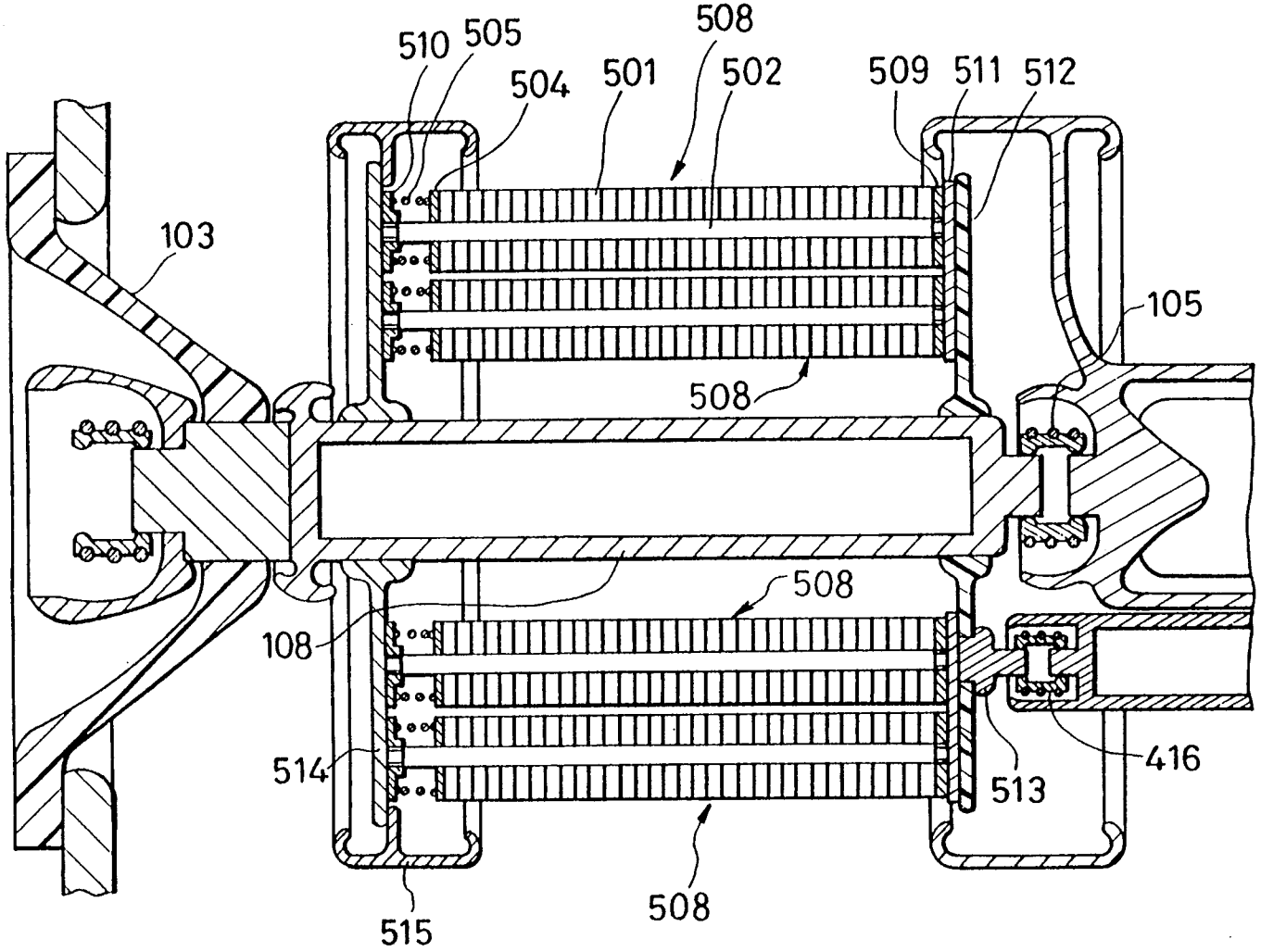
FIG. 4 is a sectional side view showing a detail constitution of resistors 508 of the circuit breaker shown in FIG. 1.

FIG. 4 is a sectional side view showing a detail constitution of the resistors 508. Further to the purpose of the resistors 508 for serving as a closing resistor of restraining the surge in closing of the circuit breaker, the resistors 508 serve as a breaking resistor to be connected in about 25 ms after breaking of the main contact 200 for restraining the surge and effectively breaking the circuit breaker. Therefore, the heat load of the resistors 508 become much larger than that of the conventional resistors which are used only for serving as a closing resistor. And thereby, the number of the resistor elements 501 constituting one of the resistors 508 generally becomes very large.

As shown in FIG. 4, the resistors 508 are respectively constituted by many of the resistor elements 501 are electrically connected in series; the series connection of the resistor elements 501 is held by an insulation bar 502 which penetrates the center holes of the resistor elements 501; an end of the insulation bar 502 in right hand of the figure is fixed on a metal adapter 509; and the other end of the insulation bar 502 is fixed on another metal adapter 510. The resistor element 501 which is positioned in the left end in FIG. 4 contacts and is electrically connected to still another metal adapter 504. A spring 505 for supplying a pressure to the resistor elements 501 is provided between the metal adapters 504 and 510.

Plural resistors 508, which are respectively configured above, are provided in parallel for satisfying a predetermined value of the resistor and a predetermined heat capacitance. The right ends of the resistors 508 in FIG. 4 are connected to an electrode 511. The electrode 511 is fixed on an insulation plate 512. The insulation plate 512 is fixed on the connection conductor 108 which is held by the insulation spacer 103. A conductor 513 is fixed on the electrode 511, which is connected to and held by a connector 416 on the same line as the moving center line of the resistor contact 400. The left ends of the resistors 508 are connected to another electrode 514 which is fixed on the connection conductor 108. A shield 515 is formed on an outer periphery of the electrode 514. The right end of the connection conductor 108 is held by the connector 105 for being electrically connected to the main contact 200 which is not shown in FIG. 5.

As configured above, the resistors 508 are held on the insulation spacer 103 which is fixed on the main tank 101 via the connection conductor 108, and the resistors 508 are connected to the main contact 200 and the resistor contact 400 via the connectors 105 and 416. Thereby, series connection circuit of the resistor contact 400 and the resistors 508 is constituted in parallel with the main contact 200.

The driving mechanism of the circuit breaker is described referring to FIG. 2. The main lever 314 are rotatably held by the frame conductor 312 and the piston rods 212 are respectively coupled to the main levers 314 via the links 304. Furthermore, the main levers 314 are respectively coupled to the insulation operation rods 303. Rods 419 are coupled to respective ends of the (right and left) levers 308 via links 316 and 317. In this state shown in FIG. 2, the links 316 and 317 are folded. Each lever 308 is rotatably held by a pin 309 at a position substantially the center between the rotation center 314*a* of the main lever 314 and the coupling point 314*b* of the link 304 and the main lever 314. An end 308*a* of the lever 308 is rotatably held by a link 310 which is also rotatably held on the frame conductor 312.

On the other hand, at coupling point 318*a* of the links 315 and 316, a lever 318 is coupled. A tube-shaped shaft 319 is fixed at the rotation center of the lever 318.

As shown in FIG. 5, the shafts 319 are respectively held by the frame conductor 312. In hollow part 319*a* of each shaft 319, a pair of first torsion bars 320 are put in from both open ends of the hollow part 319*a* and fixed thereto. The levers 318 in the right and left hands are respectively positioned on the center line of the frame conductor 312. On the other ends of the first torsion bars 320, adapters 321 for connecting the ends of the torsion bars 320 and 322 are respectively fixed. Another set of second torsion bars 322 are provided in a manner that ends of the second torsion bars 322 are respectively fixed on the adapters 321 and the other ends are fixed on the frame conductor 312. The second torsion bars 322 are provided to be parallel to the first torsion bars 320. The adapters 321 rotatably hold the torsion bars 320 and 322 by pins 323 on the frame conductor 312, respectively. The first and second torsion bars 320 and 322 serve as a driving source for breaking the resistor contact 400.

In the driving mechanism configured above, a connection of one of the first torsion bar 320 and one of the second torsion bar 322 which are fixed on the same adapter 321 constitute an elastic actuator. Two sets of the elastic actuators are provided, one set on each side of each lever 318. The first and second torsion bars 320 and 322 which are provided in left-hand in FIG. 5 store a rotation force for rotating the lever 318 positioned in left-hand in clockwise direction. Similarly, the first and second torsion bars 320 and 322 in right-hand store the rotation force for rotating the lever in right-hand in counterclockwise direction. Since the first and second torsion bars 320 and 322 are provided symmetrical to the lever 318, the lever 318 is positioned on the center line of the frame conductor 312. For that reason, the resistor contact 400, which is not shown in FIG. 5 is also provided on the center shaft of the main tank 101. Since, the first and second torsion bars 320 and 322 are connected in series via the adapter 321(see FIG. 5), the total torsion is made much larger. Furthermore, two sets of series connection of the first and second torsion bars 320 and 322 are provided , one set on each side of each lever 318, so that total driving torque of the torsion bars 320 and 322 for driving the resistor contact 400 is increased. As a result, a high power driving mechanism of the resistor contact 400 can be provided in a relatively narrow space. Furthermore, in comparison with a conventional driving mechanism comprising a coil spring as an actuator, which is well known in the art and is not shown in the figure, the deformation of the torsion bars of the present invention between the charged state and the released state of the energy is much smaller. Therefore, the energy loss used for deforming the torsion bars during the releasing of the charged energy is much smaller than that of the coil spring. As a result, the necessary energy for the actuator of the torsion bars is reduced.

Figure 6:
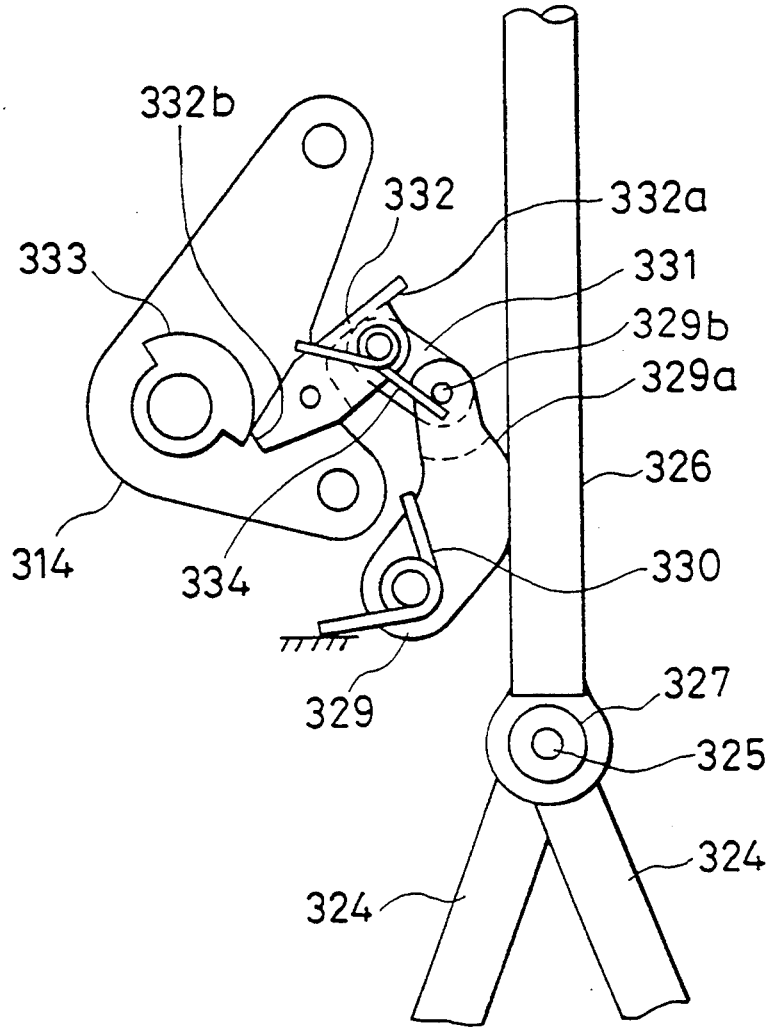
FIG. 6 is a side view showing a detail constitution of a part of a driving mechanism of the circuit breaker shown in FIG. 1.

As shown in FIG. 5, the levers 318 are respectively coupled with the same coupling pin 325 via links 324 from both sides of the coupling pin 325, symmetrically. As shown in FIG. 6 which is a side view showing a part of the driving mechanism, the coupling pin 325 is provided at an end of a piston rod 326 which is positioned at the center of the frame conductor 312. At the center of the coupling pin 325, a roller 327 is provided. As shown in FIG. 2, the piston rod 326 is slidably guided by a damper 328 which is provided at a top part of the space in the frame conductor 312. The mechanical shock at the final motion of the breaking of the resistor contact 400 by the movement of the piston rod 326 is reduced by the damper 328.

In FIG. 6, a latch 329 which is rotatably held on the frame conductor 312 (not shown in FIG. 6) is provided in left-hand in the figure and in the vicinity of the piston rod 326. In the breaking state of the circuit breaker, the latch 329 receives a rotation force in clockwise direction by a restoration spring 330, and thereby, the latch 329 contacts the piston rod 326. A coupling part 329*a* is formed on the latch 329 and it is to be coupled with the roller 327 when the resistor contact 400 is closed. An end 329*b* of the latch 329 is rotatably coupled with a link 331. The link 331 is rotatably coupled with a trigger 332. The trigger 332 is rotatably held on the frame conductor 312 (not shown in FIG. 6) at substantially the center of thereof. Furthermore, a stopper part 332*a* is formed on the right end of the trigger 332 in the figure for serving as a stopper of the rotation of the link 331 and a contact part 332*b* is formed on the left end of the trigger 332 in the figure. The contact part 332*b* is pushed to a cam 333 which is formed on the main lever 314 for breaking the resistor contact 400 (not shown in FIG. 6) in a final motion of the breaking of the main contact 200 (not shown in FIG. 6). Another restoration spring 334 is provided between the link 331 and the trigger 332 for supplying a force for making the stopper 332*a* contact the link 331 in every time.

As shown in FIG. 2, the upper ends of the insulation operation rods 303 are respectively guided by guides 311 which are formed on the frame conductor 312. The lower ends of the insulation operation rods 303 are fixed on the shafts 601. As shown in FIGS. 2 and 5, the insulation operation rods 303 are provided symmetrical with respect to the center of the insulation holder 302 or the frame conductor 312, but shifted in right- and left-hands, respectively. The shafts 601 respectively penetrate shaft seals 602 and thereby the insulation gas 102 such as $SF_6$ which is filled in the main tank 101 is gas-tightly sealed. Parts 602*a* of the shafts 601 in the air (i.e., outside of the main tank) are respectively coupled to the pistons 701 of the hydraulic operation apparatus 700 via the link mechanisms constituted by the links 603, the levers 604 which transmit the horizontal movement to the vertical movement and the rod ends 605. Since the shafts 601 are respectively shifted in right and left hands in the figure, the links 603 and the levers 604 are respectively shifted in the right and left hands with respect to the center of the insulation holder 302.

As shown in FIGS. 1 and 7, the synchronizing controller 705 which is provided substantially in center of the operation housing 109 is used for driving both of the pistons 701 in tandem. The synchronizing controller 705 consists of a breaking and a closing electric magnets 706 and 707 which are excited by receiving a breaking and a closing commands from an external apparatus and a breaking and a closing electro-magnetic valves 708 and 709 which are driven by the excitations of the electric magnets 706 and 707. Pipings 704, which are provided and connected between the pistons 701 in the right and left hands and the synchronizing controller 705, have the same diameter and the length of the piles, respectively. When the breaking valve 708 or the closing valve 709 is driven, an oil pressure is transmitted to both of the pistons 701 in right- and left-hands. Thereby, both of the pistons 701 are driven at the same time. Since both of the hydraulic operation apparatuses 700 are positioned in a manner to oppose to each other, the reaction forces of the driving forces in the right and left hand directions generated in the operation of the pistons 701 and acting on the frame of the operation housing are canceled. And thereby, the mechanical strength of the frame of the operation housing 109 is reduced. Furthermore, the vibration of the frame is also reduced.

The operations of the circuit breaker in accordance with the present invention configured above is described further referring to FIGS. 8 to 15. The operations of the switching parts provided in left- and right-hands are substantially the same. Thereby, the operation of the switching part in left-hand is described, and that in right-hand is omitted.

In the breaking state of the circuit breaker shown in FIG. 2, the piston 701 is moved in left-hand and the insulation operation rod 303 is moved down in a lowest position. The main lever 314 is stopped at a position fully rotated via the link 304 in clockwise direction. Thereby, the main contact 200 is opened. The lever 308 which is coupled to the main lever 314 is stopped at a position rotated in counterclockwise direction. The lever 318 receives the rotation force in clockwise direction by the first and second torsion bars 320 and 322, which releases the charged forces. The rotation force that is held by the piston rod 326 is stopped by the damper 328 via the link 324. Accordingly, the resistor contact 400, which is coupled to the main lever 314 by the link 315, is also opened. The links 316 and 317 are folded between the levers 308 and 318. The latch 329 contacts the rod 326 and the link 331 and the trigger 332 are folded as shown in FIG. 6.

Figure 8:
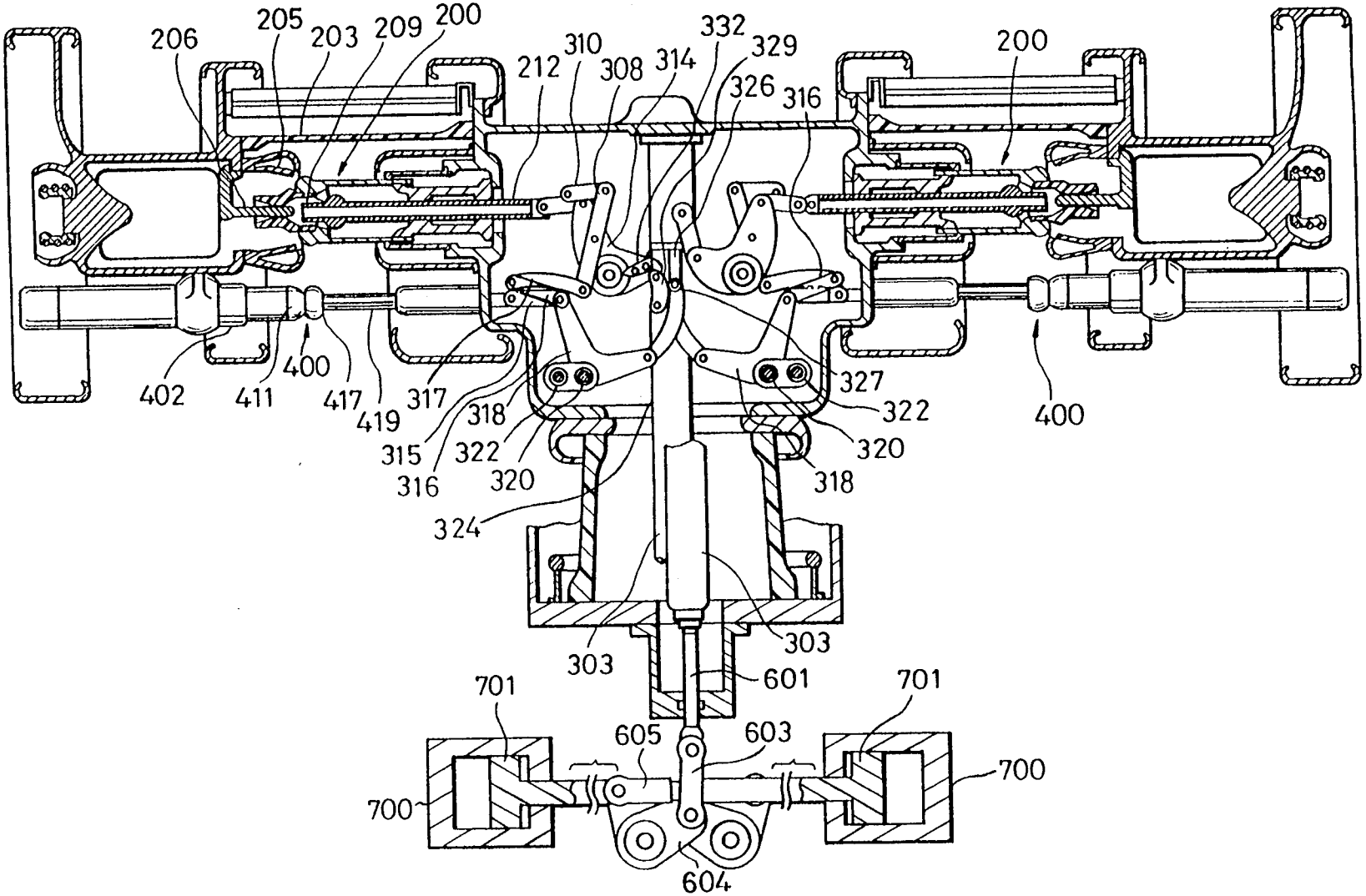
FIG. 8 is a sectional side view showing a state of the switching part of the circuit breaker in the way of the closing operation.

When a closing command is issued from the external control apparatus (which is not shown in the figure), the closing electro-magnetic valve 709 of the synchronizing controller 705 shown in FIG. 7 is operated and thereby the oil pressure signal is transmitted to both of the pistons 701 at the same time. FIG. 8 is a sectional side view showing a state of the switching part of the circuit breaker in the way of the closing operation. In FIG. 8, for example, when the piston 701 in left-hand starts to move rightward, the rod end 605 in left-hand is moved rightward and the lever 604 is rotated in clockwise direction. Thereby, the shaft 601 is moved upward via the link 603. Furthermore, the insulation operation rod 303 which is connected to the shaft 601 in moved upward. The main lever 314 which is coupled with the insulation operation rod 303 via the link 306 is rotated in counterclockwise direction. And the puffer cylinder 211 of the main contact 200 is moved to the stationary contact 201 by the rotation of the main lever 314 via the link 304 and the piston rod 212.

On the other hand, the lever 308 which is coupled to the main lever 314 by the pin 309 is rotated around the coupling point of the link 310 and the lever 308 in clockwise direction by the rotation of the main lever 314 in counterclockwise direction. The links 316 and 317 are moved leftward in a manner that the links 316 and 317 are folded each other and the coupling point of them contacts the link 315. The moving resistor contact 417 is moved to be closed via the rod 419. Since the lever 318 is coupled to the links 315 and 316, the lever 318 is rotated in counterclockwise direction. Thereby, the torsion bars 320 and 322 are charged opposing to a reaction rotation force of the torsion bars 320 and 322 in clockwise direction, since the torsion bar 320 is fixed on the levers 318.

Following to the above-mentioned closing operation of the main contact 200, the resistor contact 400 is similarly closed. Both of the levers 318 in the right and left hands are coupled by the coupling pin 325 via the links 324 shown in FIG. B, and both of the resistor contacts 400 in the right and left hands which are respectively coupled to the links 324 are operated to be closed in synchronism with each other. In case that the closing operation of, for example, the piston 701 in left-hand is prior to that in right-hand, a reaction force of the torsion bars 320 and 322 in right-hand is applied to the piston 701 in left-hand besides the reaction force of the torsion bars 320 and 322 in left-hand. As a result, both of the pistons 701 in right and left hands are controlled to be closed in synchronism with each other, and thereby the main contacts 200 in both hands are also operated to be closed in synchronism with each other.

As shown in FIG. 8, at first, the moving resistor contact 417 contacts the stationary resistor contact 411 and thereby the resistor contact 400 is closed. As a result, the resistors 508 is electrically connected in series with the resistor contact 400 for reducing the surge which occurs in the closing operation. Furthermore, the moving resistor contact 417 pushes the stationary resistor contact 411 in the resistor contact case 402 and compresses the restoration spring 404. Following to this operation, the moving arc contact 209 is closed to the stationary arc contact 206 and the main moving contact 208 is closed to the main stationary contact 205, serially.

Figure 11:
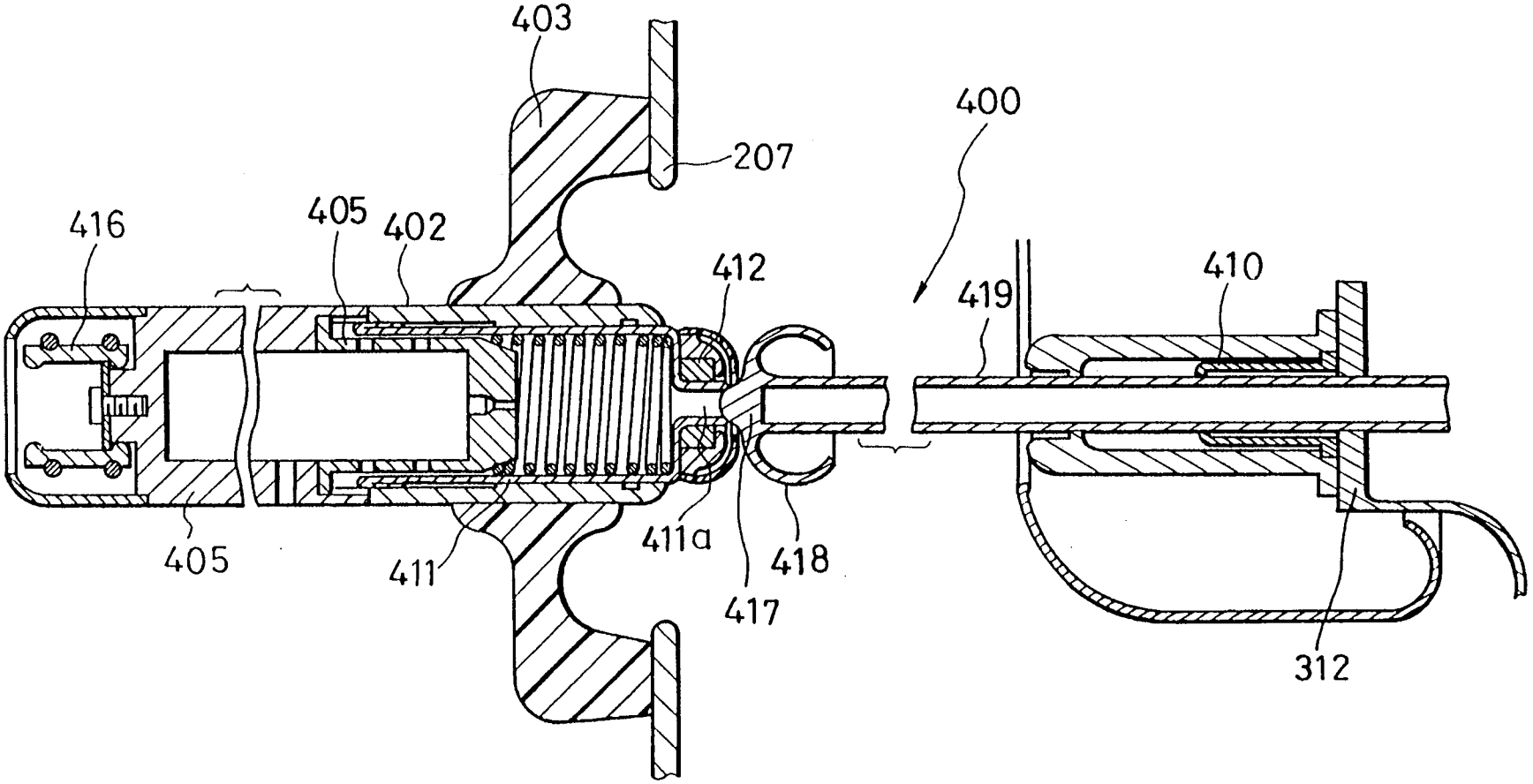
FIG. 11 is a sectional side view of the resistor contact 400 in the closed state.

FIG. 11 is a sectional side view showing the closed state of the resistor 400. As shown in FIG. 11, when the stationary resistor contact 411 is pushed in the resistor contact case 402 by the moving resistor contact 417, the insulation gas 102 in a space formed between the piston 405 and the stationary resistor contact 411 is compressed. When the compressed insulation gas 102 is exhausted from the orifices 406, the resistance force between the insulation gas 102 and the orifices 406 serves as a damping force.

Figure 9:
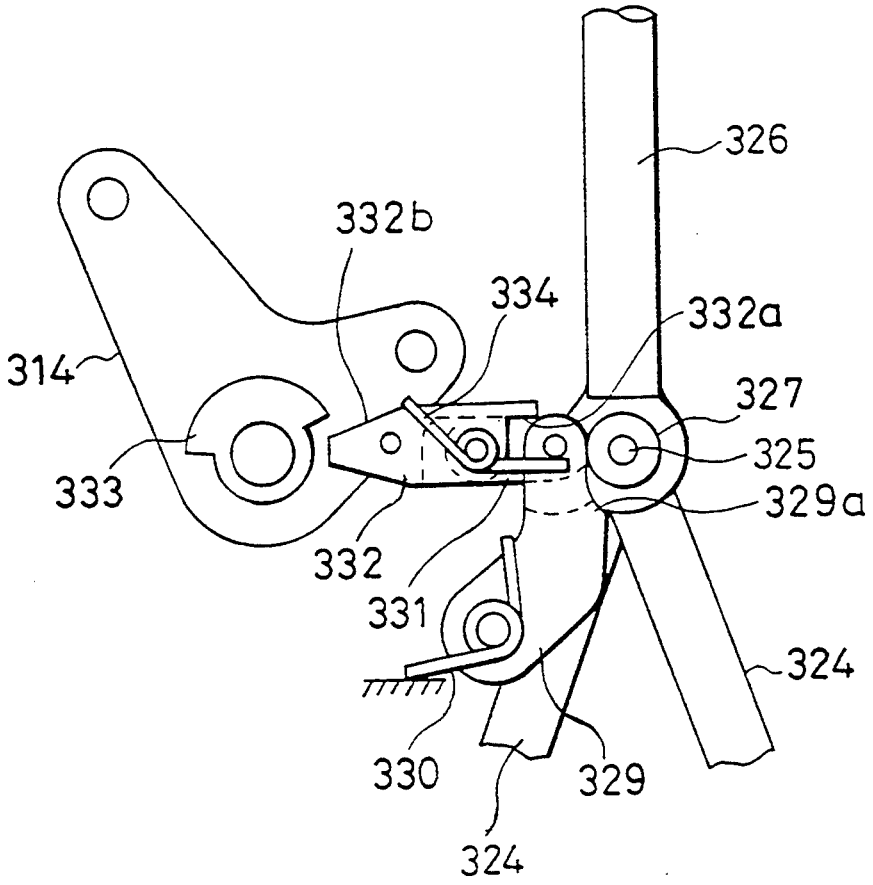
FIG. 9 is a side view of the part of the driving mechanism in the closed state of the circuit breaker.

FIG. 9 is a side view showing a part of the driving mechanism of the circuit breaker in the way of the closing operation. As shown in FIG. 9, since the roller 327 is moved upward by the rotation of the lever 318 in counterclockwise direction via the links 324, the latch 329 which was slidably guided by the rod 326 is moved to a position where the latch 329 is able to couple with the roller 327 by the rotation force of the restoration spring 330 in clockwise direction in the final step of the closing operation. The contact part **332*b* of the trigger 332 is released from the restriction by the cam 333 as a result of the rotation of the main lever 314 in counterclockwise direction. Following such the motions, the link 331 which is coupled to the latch 329 and the trigger 332 are extended by the force of the restoration spring 334 and the motion of the link 331 and the trigger 332 is stopped when the stopper 332*a* contacts the link 331**.

Figure 10:
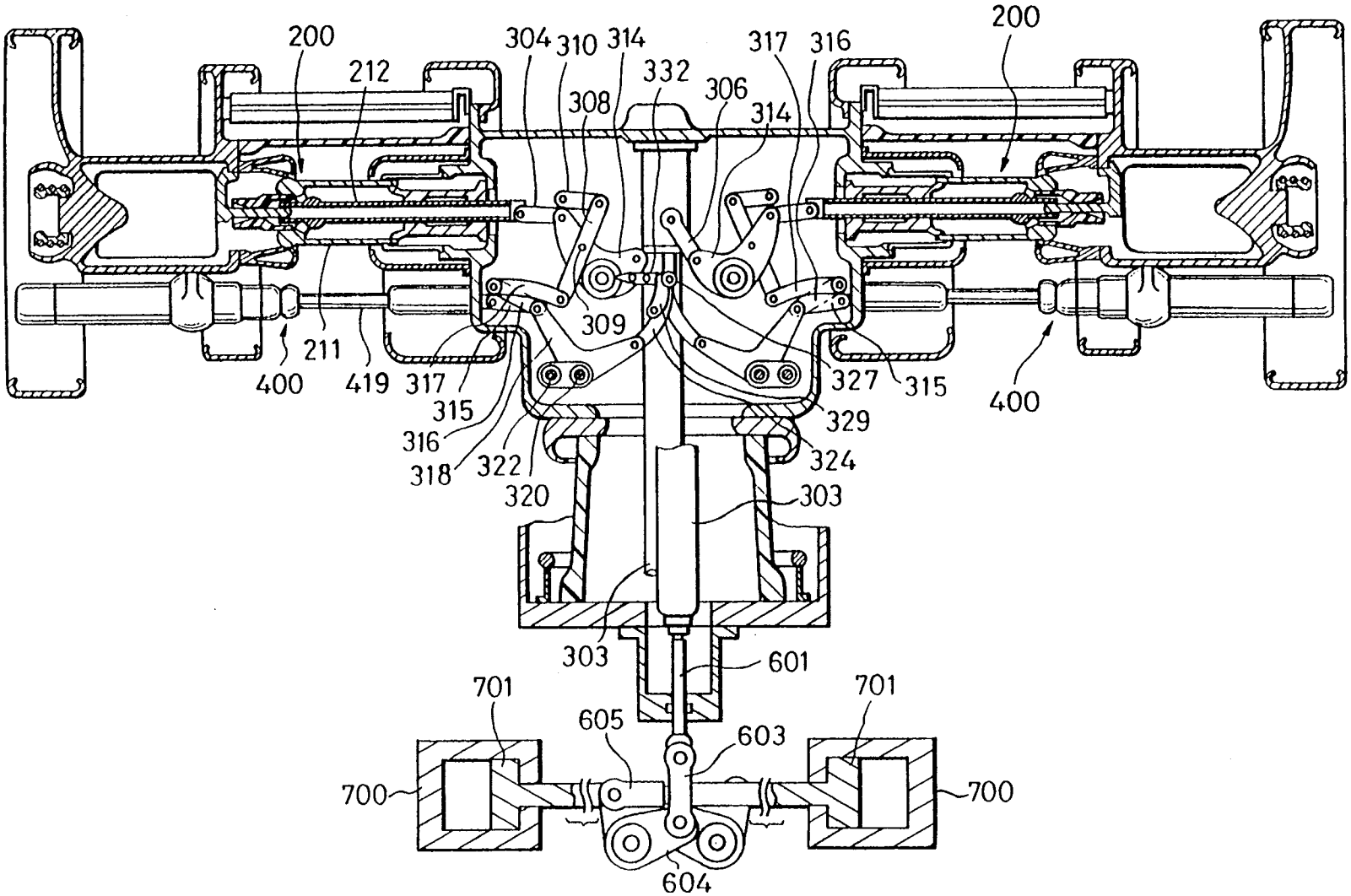
FIG. 10 is a sectional side view showing another state of the switching part of the circuit breaker shown in the way of the closing operation.

FIG. 10 is a sectional side view showing the closed state of the switching part of the circuit breaker. In FIG. 10, the piston 701 has reached to the final position and the closing operation of the circuit breaker has been completed. The circuit breaker is maintained in the closed state and the torsion bars 320 and 322 are charged by the force acting on the piston 701 in right-hand direction. At this time, the torsion bars 320 and 322 are twisted by the rotation angle of the lever 318 from their posture in the breaking state of the circuit breaker. The coupling part **329*a* of the roller 327 and the latch 329 is maintained with a predetermined gap as shown in FIG. 9. The resistor contact 400 is closed as shown in FIG. 11**.

The breaking operation of the circuit breaker is described. In the closed state of the circuit breaker as shown in FIG. 10, when a breaking command is issued from the external control apparatus (which is not shown in the figure), the breaking electro-magnetic valve 708 of the synchronizing controller 705 is driven and a oil pressure signal is transmitted to both of the pistons 701 at the same time. For example, the piston 701 and the rod end 605 in left-hand start to move in leftward. The lever 604 rotates in counterclockwise direction. The shaft 601 is moved downward by the rotation of the lever 604 via the link 603. Furthermore, the insulation operation rod 303 is also moved downward. And the main lever 314 which is coupled to the insulation operation rod 303 via the link 306 is rotated clockwise direction. The puffer cylinder 211 of the main contact 200 is moved to the center of the frame conductor 312 via the link 804 and the piston rod 212.

On the other hand, the lever 308, which is coupled to the main lever 814 by the pin 309, is rotated in counterclockwise direction around the center of the coupling point of the link 310 and the lever 308 by following to the rotation of the main lever 314 in clockwise direction. The links 316 and 317 in left-hand is moved in rightward in the figure. The lever 318, which is coupled to the links 316 and 317, is rotated in clockwise direction by the charged force of the torsion bars 320 and 322.

Figure 12:
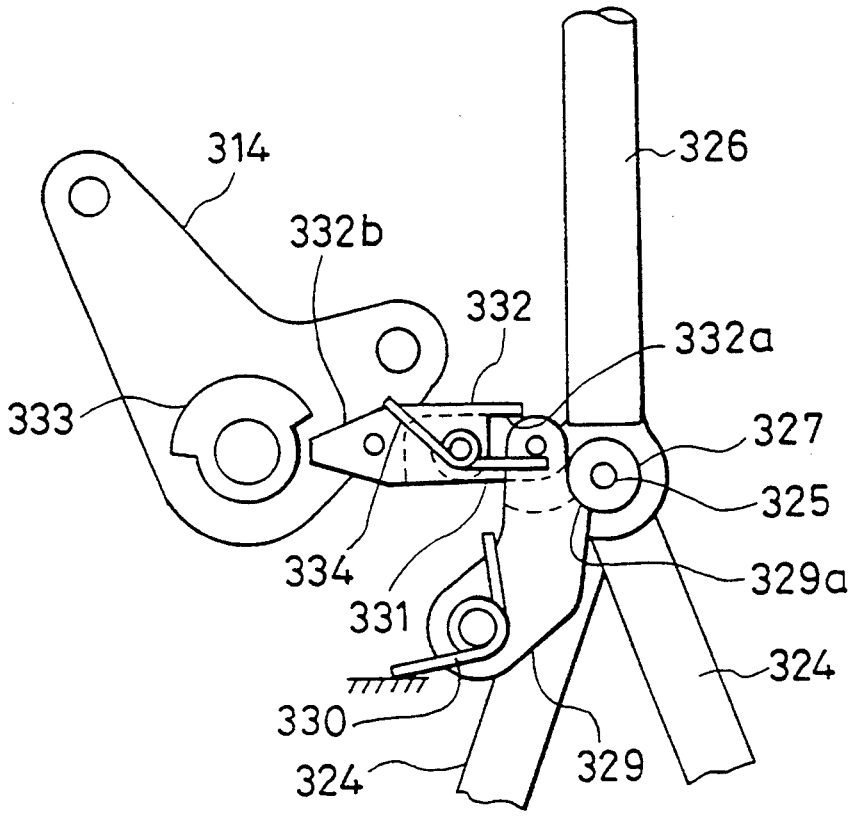
FIG. 12 is a side view showing the part of the driving mechanism, especially, a fourth link mechanism of the circuit breaker in an initial condition of the breaking operation.

FIG. 12 is a side view showing the part of the diving mechanism of the circuit breaker in the way of the breaking operation. In FIG. 12, the roller 327, however, is coupled with the coupling part **329*a* of the latch 329 when the piston rod 326 which is coupled to the lever 318 is moved a little. A rotation force in counterclockwise direction acts on the latch 329 with respect to the rotation force of the restoration spring 330. A force in left-hand due to the rotation force acts on the link 331, and thereby, a rotation force in clockwise direction acts on the trigger 332. As a result, the stopper part 332*a* of the trigger 322 contacts the link 331 and the engagement of the roller 327 and the coupling part 329*a* of the latch 329 is maintained. As mentioned above, the latch 329 is engaged with the roller 327** in a relatively initial stage of the breaking operation of the circuit breaker, and hence mechanical reliability of the driving mechanism of the circuit breaker is increased.

By the engagement of the latch 329 and the roller 327, the torsion bars 320 and 322 are held in the charged state . Furthermore, since the motions of the lever 318, the link 31S, the rod 419, and the moving resistor contact 417 are restrained, the resistor contact 400 is maintained in the closed state.

Figure 13:
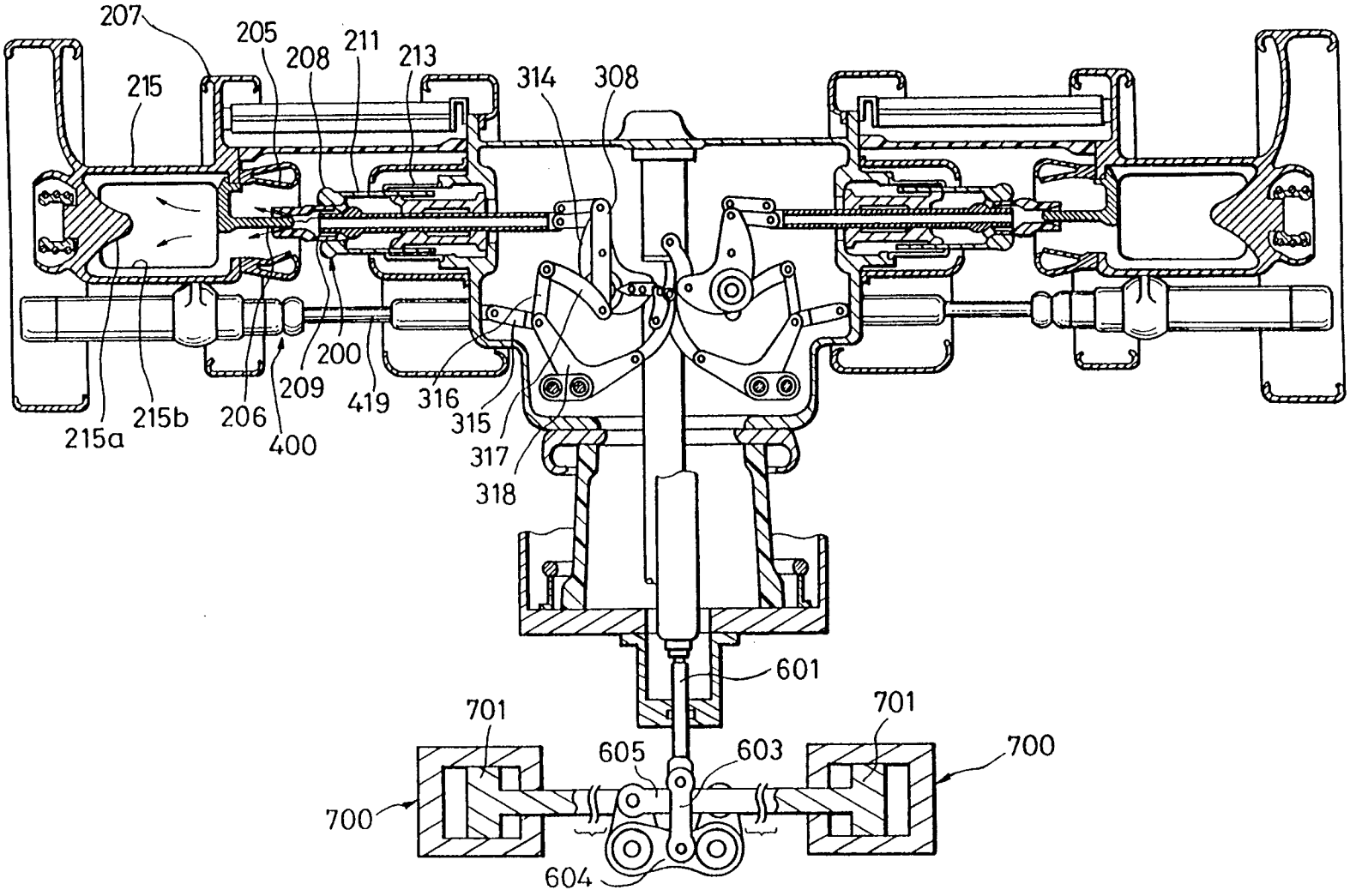
FIG. 13 is a sectional side view showing a state of the switching part of the circuit breaker in the way of a breaking operation.

FIG. 13 is a sectional side view showing a state of the switching part of the circuit breaker in the way of the breaking operation. In FIG. 13, owing to the rotation of the main lever 314 in clockwise direction, the main moving contact 208 of the main contact 200 is departed from the main stationary contact 20S. After that, the moving arc contact 209 is departed from the stationary arc contact 206. At this time, an arc occurs between the moving arc contact 209 and the stationary arc contact 206.

As shown in FIG. 13, when the lever 308 is rotated in counterclockwise direction, the links 316 and 317 are moved in a manner to expand the angle between them since the coupling part of the link 316 and the lever 318 is restrained. Therefore, only the main contact 200 is opened under the condition that the resistor contact 400 is closed.

When the insulation gas 102 which is compressed by the piston 213 and the puffer cylinder 211 blows the arc, and thereby, the current flowing the main contact 200 is cut off, a limited current flows through the resistor contact 400 and the resistors 508. By such the resistors 508, an overvoltage in the breaking operation is reduced.

As shown in FIG. 13, most of the insulation gas 102 which blows the arc is exhausted from the exhaust openings **215*b* of the conductor 215 without disturbance of the branching part 215*a* of the conductor 215. Since a shield 207 is provided between the resistors 508 and the exhaust openings 215*b*, the exhausted heated insulation gas 102 does not blow the resistors 508, directly. Therefore, the resistors 508 are not damaged by the heat of the insulation gas 102 and the voltage proof of the resistors 508** is not reduced.

Figure 14:
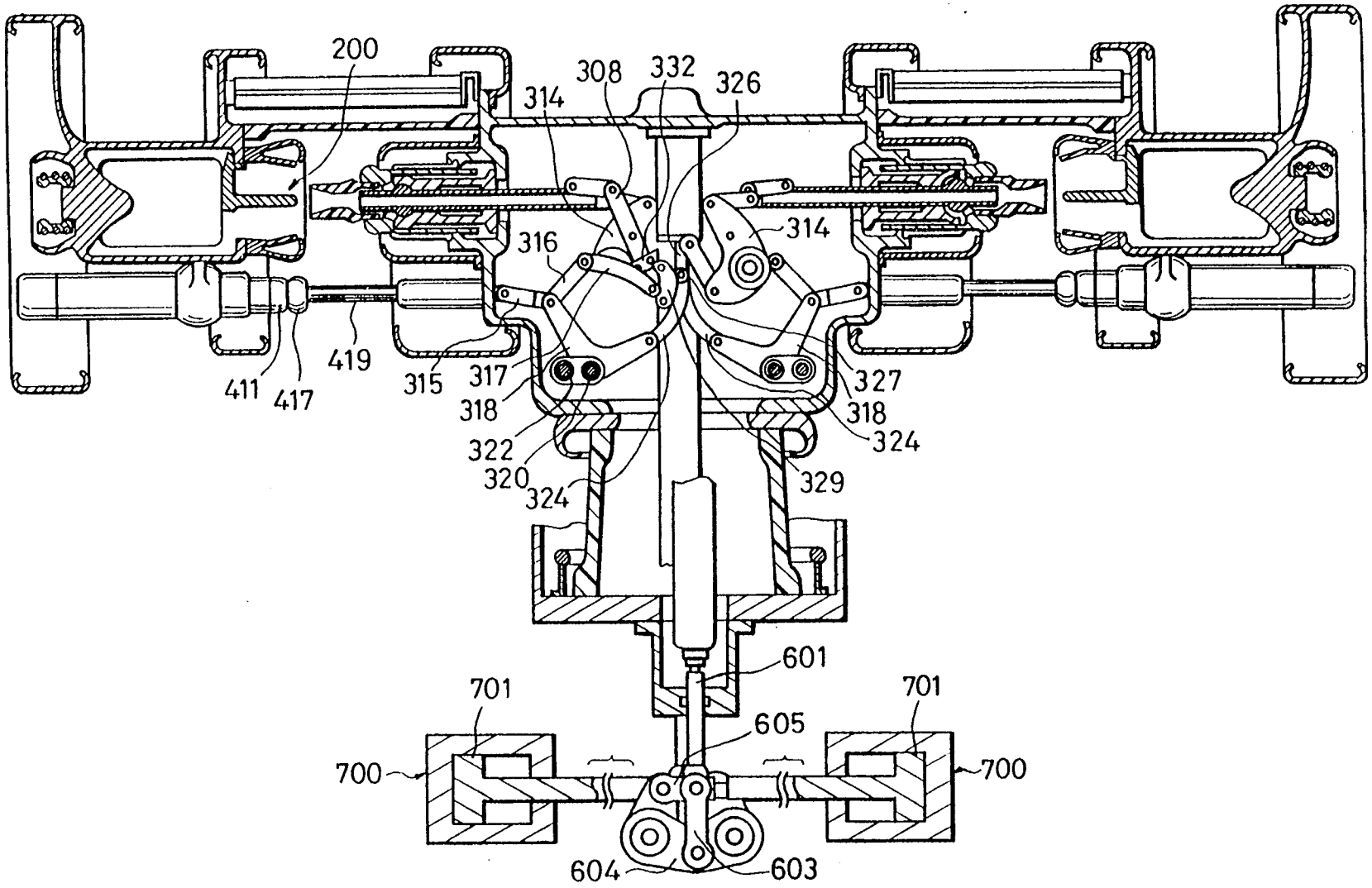
FIG. 14 is a sectional side view showing another state of the switching part of the circuit breaker in the way of the breaking operation.

In FIGS. 10 and 12, when the main lever 314 is further rotated in clockwise direction and approaches to the final step of the breaking operation, the cam 333 which is provided on the main lever 314 pushes the contact part **332*b* of the trigger 332, and the trigger 332 starts to rotate in counterclockwise direction. Therefore, the stopper part 332*a* of the trigger 332 departs from the link 331, and the trigger 332, and the link 331 are folded with respect to the force of the restoration spring 334. As a result, the restraint of the latch 329 is released and the latch 329 starts to rotate in counterclockwise direction. And the engagement of the latch 329 and the roller 327 is also released. Since the roller 327 becomes free from the restraint of the latch 329, the piston rod 326 starts to move downward by the rotation force of the torsion bars 320 and 322 which are fixed on the lever 318. Furthermore, the moving resistor contact 417 starts to move in right-hand to be opened by the rotation of the lever 318 via the link 315 and the rod 419. Following to the motion of the moving resistor contact 417, the stationary resistor contact 411 starts to move rightward by the force of the restoration spring 404 which is provided in the stationary resistor contact 411. FIG. 14 is a sectional side view showing the breaking state of the switching part of the circuit breaker. In FIG. 14, the piston 701 reaches the breaking position, and the breaking operation of the main contact 200 is completed. The main ever 314 and the lever 308 are restraint at the breaking positions, and the links 316 and 317** are extended straight.

Figure 15:
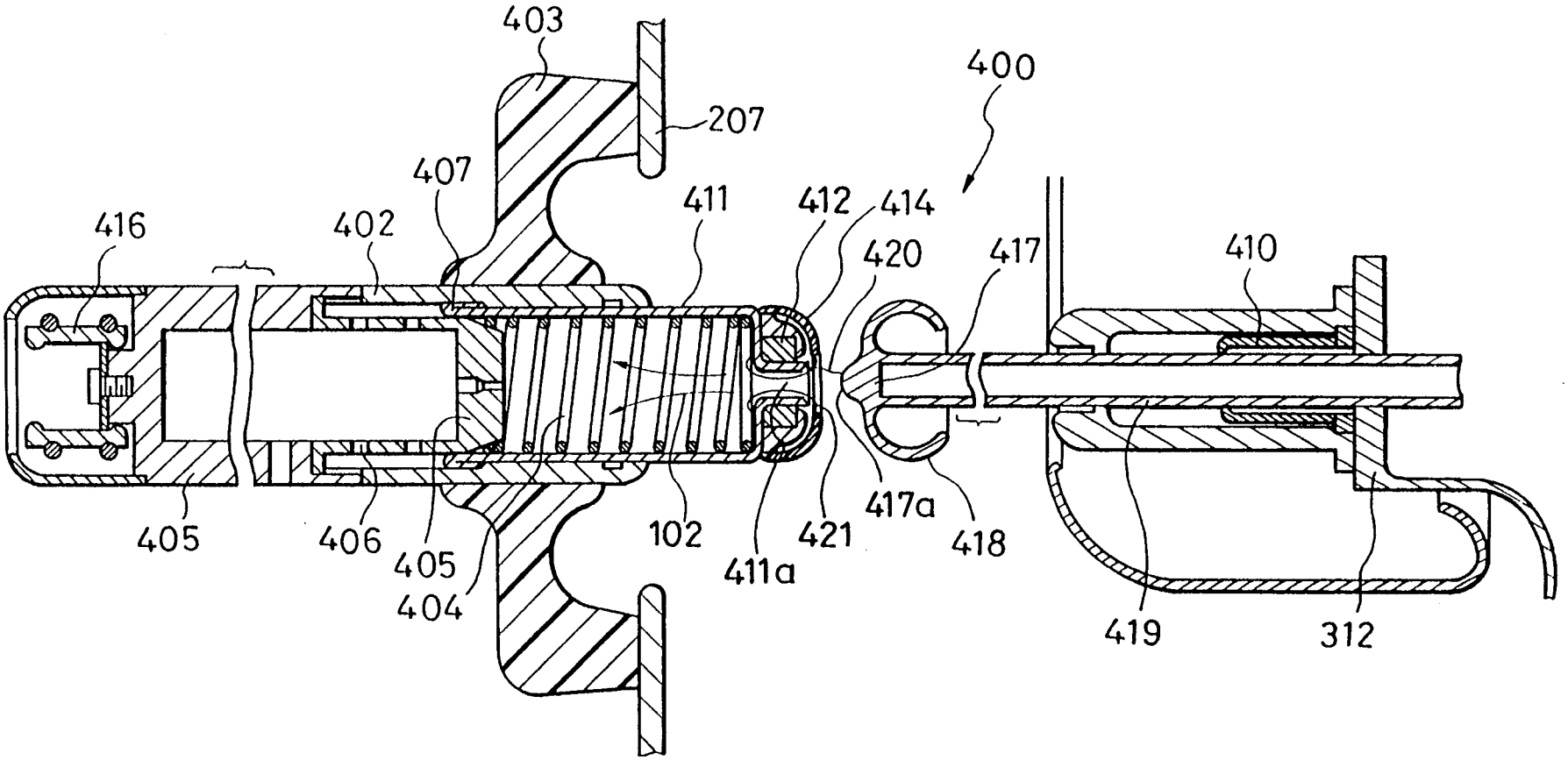
FIG. 15 is a sectional side view showing a state of the resistor contact 400 in the way of the breaking operation.
Figure 16:
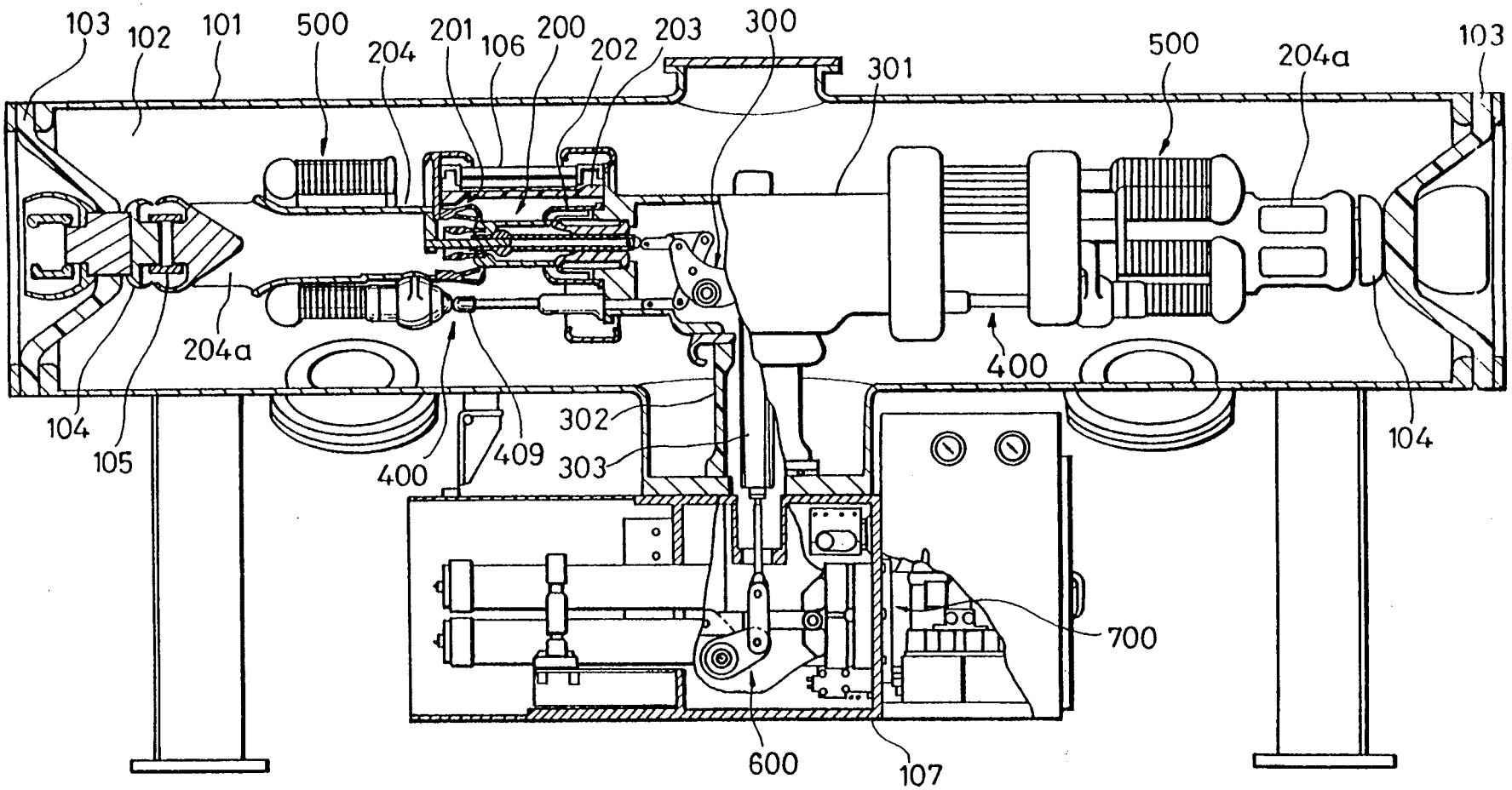
FIG. 16 (Prior Art)
FIG. 16 is the sectional side view showing the constitution of the conventional circuit breaker.
Figure 17:
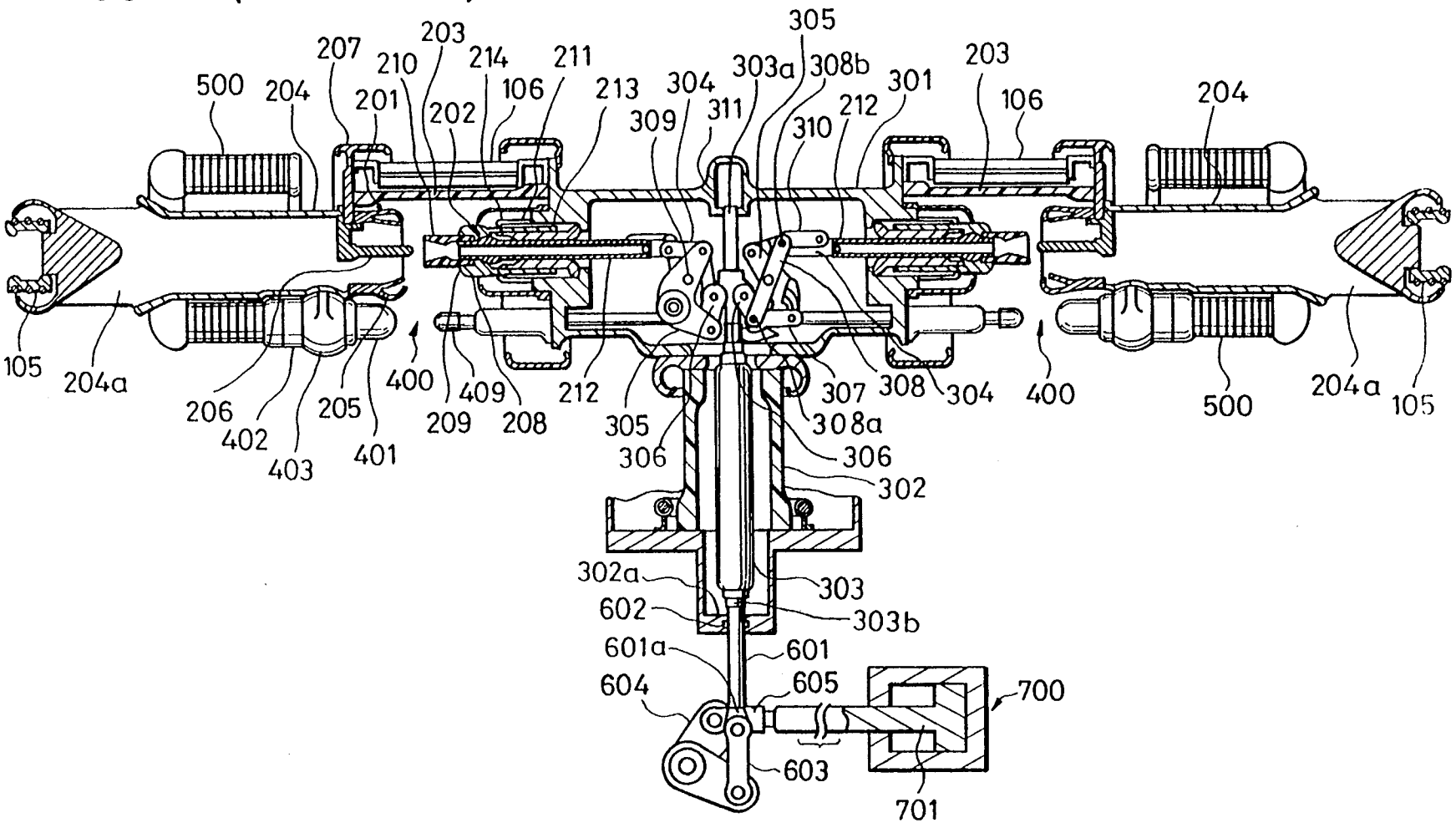
FIG. 17 (Prior Art)
FIG. 17 is the sectional side view showing the detail constitution of the switching part of the conventional circuit breaker.
Figure 18:
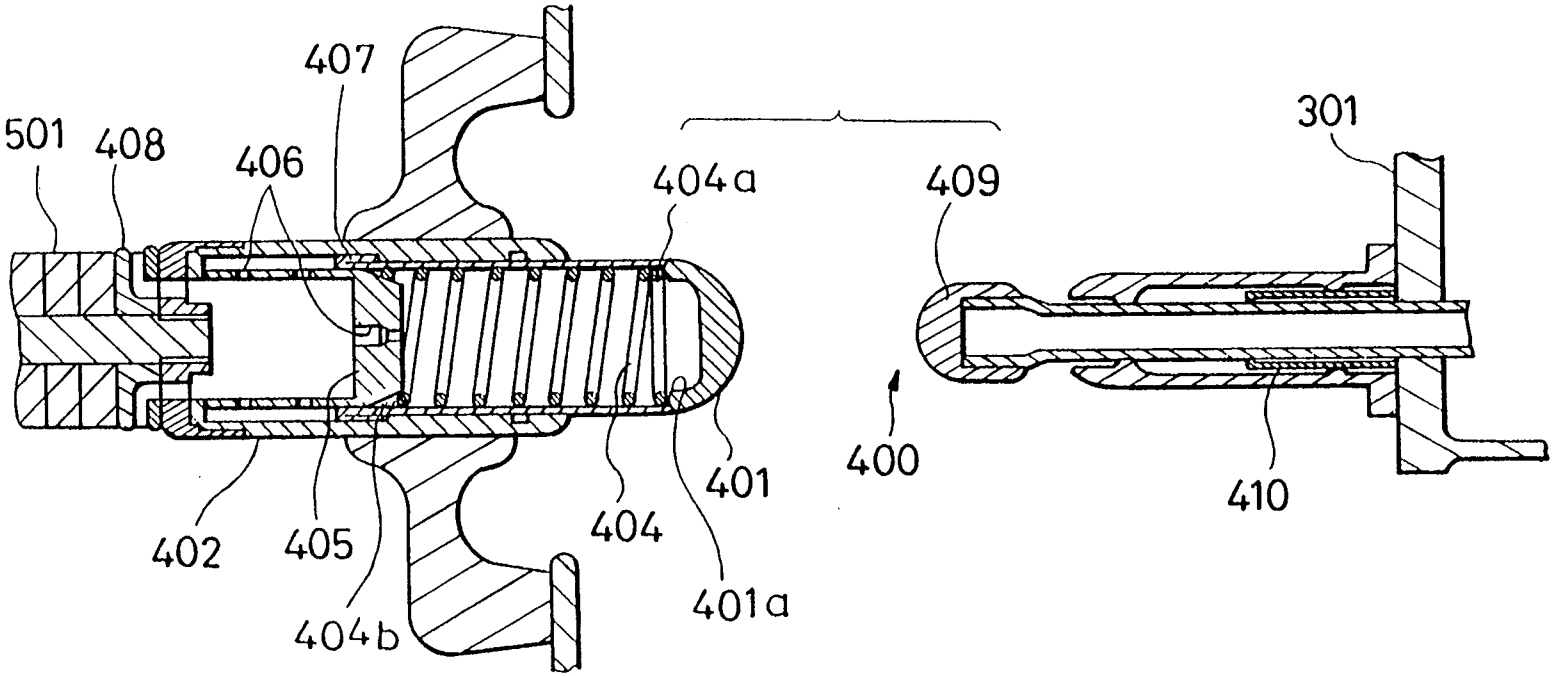
FIG. 18 (Prior Art)
FIG. 18 is the sectional side view showing the detail constitution of the resistor contact 400 of the conventional circuit breaker.
Figure 19:
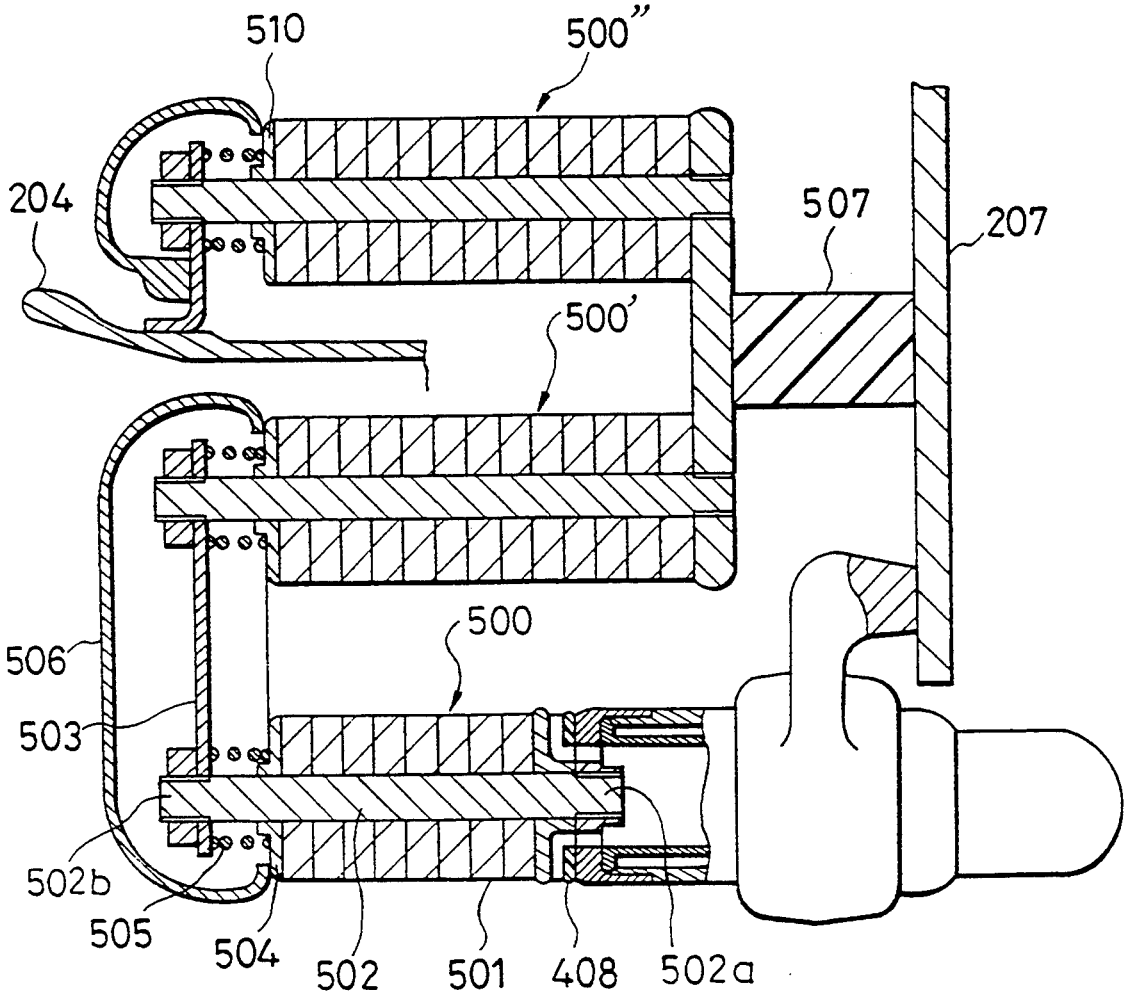
FIG. 19 (Prior Art)
FIG. 19 is the sectional side view showing the detail constitution of the resistors 500 of the conventional circuit breaker.
Figure 20:
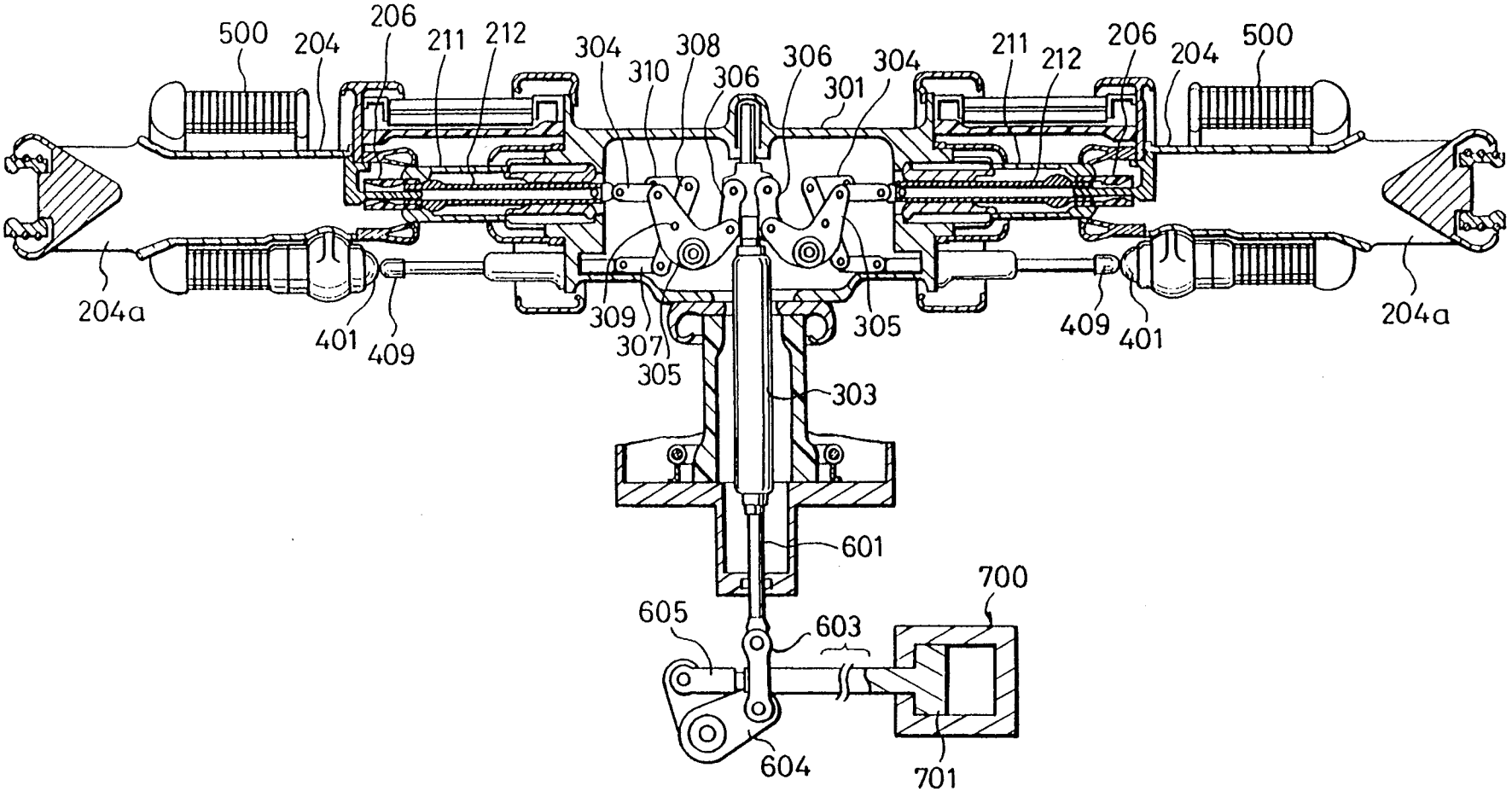
FIG. 20 (Prior Art)
FIG. 20 is the sectional side view of the state of the switching part of the conventional circuit breaker in the way of the closing operation.
Figure 21:
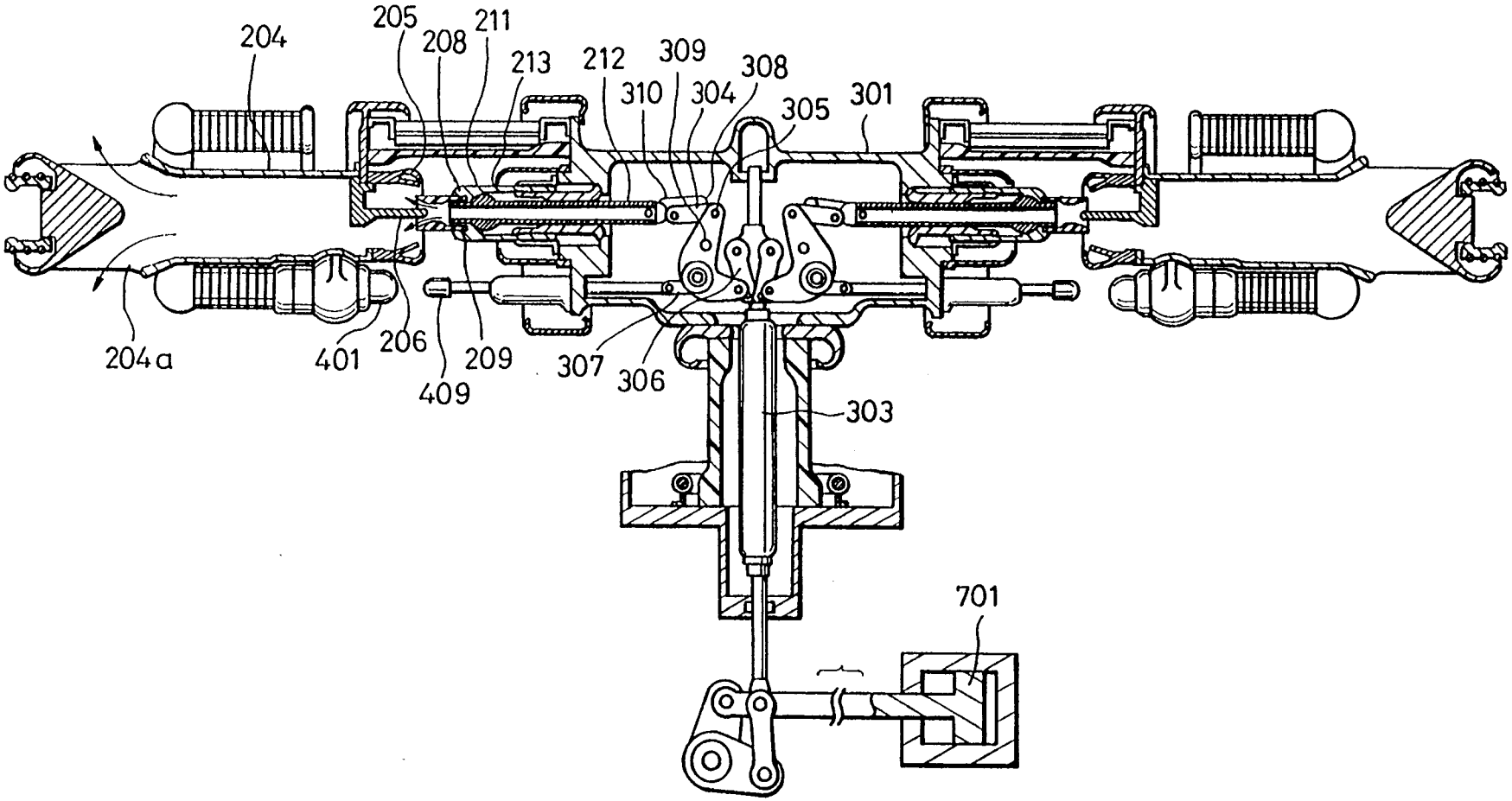
FIG. 21 (Prior Art)
FIG. 21 is the sectional side view of the state of the switching part of the conventional circuit breaker in the way of the breaking operation.

When the lever 318 is further rotated in clockwise direction by the rotation force of the torsion bars 320 and 322, the link 317, which is restrained at an end thereof by the lever 308, is moved in a manner to reduce the angle between the links 316 and 317. Since the levers 318 in both of the left and right hands are coupled by the coupling pin 325, the levers 318 are driven in synchronism with each other even when the rotation forces charged in the torsion bars 320 and 322 in the left and right hands are different. Therefore, the moving resistor contacts 417 in the right and left hands are also moved in synchronism with each other. The moving resistor contact 417 in left-hand moves rightward. FIG. 15 in a sectional side view showing a state of the resistor contact 400 in the way of the breaking operation. As shown in FIG. 15, the moving resistor contact 417 is departed from the stationary resistor contact 411, and an arc 420 occurs between them.

TABLE 1

| Condition of breaking | Value of current to be cut (kA) | Rate of rise of transient recovery voltage (kV/μs) | Peak value of recovery voltage (kV) |
|---|---|---|---|
| BTF 1~5 | ~1 | 2.5 | 1186 |
| Out of phase breaking | ~2 | 1.58 | 1950 |
| Lead small current to be cut | ~0.6 | 0.78 | 2030 |

BTF: Breaker Terminal Fault

The above-mentioned table 1 shows the analyzed results of the share of the resistor contact 400 in case of using the breaking resistor of 750 Ω in a 1,000 kV system. As shown in the table 1, the current flowing in the resistor contact in the breaking operation is smaller than 2 kA irrespective of the intensity of the current to be cut, since the current flowing is the resistor contact is limited by the resistors. The rate of rise of transient recovery voltage which shows the degree of heaviness of the breaking is fairly higher about 2.5 kV/μs. Even though the value of the current which is to be cut is small, a cooling mechanism of the arc such as a puffer mechanism is necessary for arc-extinguishing of the resistor contact similar to the main contact. Furthermore, since the recovery voltage which is applied to the resistor contact after the current breaking is as fairly high as about 2000 kV, it is necessary to break the resistor contact in a high speed.

As is known from Hamano et.al.: "Investigation of a New Extinguishing Principle for GCB" T.IEE Japan, Vol.111-B,No. 2, (1991), the arc extinguishing by using the magnetic field is effective in a region that the value of the current is smaller than several kilo-volts. Furthermore, Hamano et.al. teaches that the rate of rise of the limited transient recovery voltage in case of breaking the current of 2 kA with the rotary magnetic arc extinguishing is about 2–3 kV/μs which is four times as large as that in the case without the magnetic arc extinguishing. From these facts, the arc extinguishing performance of the circuit breaker is effectively increased by providing a magnetic field generator in the resistor contact 400 for expanding the arc by the magnetic field, since the current flowing on the resistor contact 400 is always small.

As shown in FIG. 15, the permanent magnets 412 are provided on the outer periphery of the stationary resistor contact 411. Since the magnetic field 421 which is generated by the permanent magnets 412 acts on a current of the arc 420 in radial direction, the arc 420 is rotationally moved and expanded in the radial direction. On the other hand, the stationary resistor contact 411 which is departed from the moving stationary contact 417 is pushed out by the restoration spring 404. Therefore, a flow of the insulation gas 102 which is sucked into the stationary resistor contact 411 is generated. The arc 420 is expanded by the magnetic field and blown by the insulation gas, so that the cooling of the arc is accelerated and made to be easily broken. Since the moving resistor contact 411 is not a puffer type one, the load in the breaking operation is not increased by the pressure rise of the puffer piston. Furthermore, since the moving resistor contact 417 can be made light weight because of the simple constitution, the resistor contact 400 can be driven even when the torsion bars 320 and 322 output a low power. As a result, a constitution of the circuit breaker, which can be fit for the use of the high transient recovery voltage applied on the resistor contact, can easily be provided.

When the lever 318 is further rotated in clockwise direction by the charged force of the torsion bars 320 and 322 and the piston rod 326 is moved below, the moving speed of the moving resistor contact 417 is gradually reduced by the braking force generated by the damper 328 in the final step of the breaking operation of the resistor contact 400. Finally, the moving resistor contact 417 stops at the breaking position as shown in FIG. 4 so as to sufficiently reduced the collide shock by the damper 328.

Although the present invention has been described in terms of the presently preferred embodiments, it is to be understood that such disclosure is not to be interpreted as limiting. Various alterations and modifications will no doubt become apparent to those skilled in the art after having read the above disclosure. Accordingly, it is intended that the appended claims be interpreted as covering all alterations and modifications as fall within the true spirit and scope of the invention.

What is claimed is:

1. A circuit breaker comprising:

a tank having a long axis along an axial direction and filled with an insulation gas;

two main contacts, each main contact comprising a main moving contact and a stationary main contact, which are electrically connected in series and are provided in said tank in a manner such that the main moving contacts of said main contacts are driven in the axial direction of said tank, relative to said tank, for contacting and departing from the stationary main contacts of said main contacts;

first and second resistor contacts, each resistor contact comprising series connections of resistors and a movable resistor contact, each of the first and second resistor contacts is electrically connected in parallel with one of said two main contacts when the main contacts and the first and second resistor contacts are closed;

first and second insulation operation rods each having first and second ends and to be driven in a direction that is perpendicular to the axial direction and provided in said tank between said two main contacts;

first and second first link mechanisms, the first link mechanism coupled to the first end of the first insulation operation rod and to one of the main contacts, the second first link mechanism coupled to the first end of the second insulation operation rod and to the other one of the main contacts, driving means for driving the insulation operation rods;

first and second second link mechanisms, coupling the second ends of the first and second insulation operation rods, respectively, to said driving means;

means for loading the first and second resistor contacts for maintaining the first and second resistor contacts in a closed position, said means for loading comprising elastic members;

first and second third link mechanisms, coupled to the first and second insulation operation rods, respectively, for closing the first and second resistor contacts prior to the closing of said two main contacts and for loading the elastic members using the driving forces provided by said driving means when said two main contacts are driven for closing by said driving means, via said insulation operation rods;

a fourth link mechanism for holding loaded said elastic members;

coupling means for coupling said third link mechanisms to said fourth link mechanism; and releasing means for releasing the load on said elastic members by said fourth link mechanisms, thereby breaking said first and second resistor contacts after the breaking of said two main contacts, when said first and second insulation operation rods are driven in a manner to break said two main contacts.

2. A circuit breaker in accordance with claim 1, wherein:

said two main contacts are provided symmetrically with respect to the axial direction and are provided along the center of said tank such that their movement for opening and closing is along the axial direction;

said first and second insulation operation rods are aligned perpendicular to the moving direction of said two main contacts; and two hydraulic operation apparatuses are provided symmetrically with respect to the alignment direction of the first and second insulation operation rod.

3. A circuit breaker in accordance with claim 1, further comprising:

a damper, which moves linearly, is coupled to said coupling means, for reducing a shock at a final stage of motion of said resistor contact during breaking operation.

4. A circuit breaker in accordance with claim 1 wherein said first and second resistor contacts are provided substantially just below said two main contacts in a manner that the moving directions of said first and second resistor contacts are substantially the same as the axial direction of the tank.

5. A circuit breaker in accordance with claim 1, wherein:

moving directions of said two main contacts are opposite to each other during each of the breaking and closing operations;

said first and second insulation operation rods are arranged perpendicular to the moving directions of said two main contacts;

each of said first link mechanism comprises a first link which is coupled to an end of one of said first and second insulation operation rods, a second link which is coupled at an end thereof to one main moving contact of said two main contacts, and a first lever which is coupled between the other end of said first link and the other end of said second link and is rotatably borne on a fixed base; and said third link mechanism comprises a second lever which is rotatably coupled to an arm of said first lever in the vicinity of said one main moving contact, a third link which is coupled with a moving resistor contact of one of said first and second resistor contacts, a fourth link which is disposed to overlap said first lever, coupled with said third link at an end thereof when said two main contacts are in the breaking position and coupled with an end of one of said first and second second levers at the other end thereof, and a fifth link which is rotatably borne on said fixed base and coupled with the other end of said one of said first and second second levers.

6. In a circuit breaker comprising a tank having a first axis, main contacts, and resistor contacts including resistors, further comprising:

an insulation holder that is fixed to said tank, wherein said main contacts and said resistor contacts are held perpendicular to said first axis of said tank by said insulation holder;

an insulation spacer, wherein an end of each of said resistors of said resistor contacts is fixed on said tank via said insulation spacer;

a connection conductor having a connection conductor end, wherein said connection conductor end is disposed in parallel with said resistors and is fixed on said tank via said insulation spacer;

a first movable conductive connection part, wherein a main stationary contact of said main contact and said conductor are connected by said first movable conductive connection part; and a second movable conductive connection part, wherein a resistor stationary contact of said resistor contact and said resistors are connected by said second movable conductive connection part.

7. A circuit breaker in accordance with claim 6, wherein:

said main contacts and said resistors are disposed in the first axial direction of said tank;

said main contacts each serve as a puffer cylinder for spouting an insulation gas to said main stationary contact thereof;

a conductor, which is electrically connected to one main stationary contact, is disposed between said one main contact and the resistors;

a branch part is formed on said conductor in the vicinity of the resistors for preventing said spouting of said insulation gas onto the resistors during the breaking operation of said main contacts.

8. A circuit breaker in accordance with claim 1, 2, 3, 4, or 5, further comprising:

damping rods;

sixth links that are respectively coupled at an end thereof to said two third link mechanism;

the other ends of said sixth links are respectively coupled to the damping rods;

the load on each of the elastic members is held by an engagement of a latch with said damping rods when the register contacts are closed; and a fourth link mechanism is provided for releasing the load on the elastic members in a manner that the main contact is opened by a rotation of said first lever in a predetermined angle and triggering said engagement of said latch and said damping rod by further rotation of said first lever by another predetermined angle after the breaking of the main contacts.

9. The circuit breaker according to claim 6, further comprising:

a series connection of two main contacts in a tank filled with an insulation gas in a manner that moving contacts of the main contacts are movable in an axial direction of said tank thereby to open and close the main contacts;

series connections of resistors and a resistor contact that are in said tank and are electrically connected in parallel with said main contacts;

means for closing said resistor contacts prior to closing of the main contacts and for opening said resistor contacts after breaking of the main contacts:

said resistor contacts comprise a first contact having a circular contacting part and a second contact contacting and departing from said first contact; and magnetic field generating means on an outer periphery of an end of said circular contacting part of said first contact of the resistor contacts.

10. A driving mechanism of a circuit breaker for breaking and closing a switching part, comprising:

a frame;

a first coupling member that is rotatably held on the frame at a first point;

a second coupling member that is rotatably held on the frame at a second point;

a first pair of adapters that are located along a line between the first and second coupling members;

a first pair of torsion bars, each torsion bar of the first pair having first and second ends, the first ends of the first pair of torsion bars are spaced from one another and held by the first coupling member so that the first ends of the first pair of torsion bars are equidistant from the first point, the second ends of the first pair of torsion bars are spaced from one another and held by the first pair of adapters;

a second pair of torsion bars, each torsion bar of the second pair having first and second ends, the first ends of the first pair of torsion bars are spaced from one another and held by the second coupling member so that the first ends of the second pair of torsion bars are equidistant from the second point, the second ends of the first pair of torsion bars are spaced from one another and held by the first pair of adapters.

* * * * *